US011274809B2

(12) United States Patent
Henkel

(10) Patent No.: US 11,274,809 B2
(45) **Date of Patent: *Mar. 15, 2022**

(54) PORTABLE BEACH VOLLEYBALL LIGHTING SYSTEM

(71) Applicant: Francis J. Henkel, Long Beach, NY (US)

(72) Inventor: Francis J. Henkel, Long Beach, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/316,599

(22) Filed: May 10, 2021

(65) Prior Publication Data

US 2021/0262641 A1 Aug. 26, 2021

Related U.S. Application Data

(63) Continuation-in-part of application No. 17/199,746, filed on Mar. 12, 2021, now Pat. No. 11,199,310, (Continued)

(51) Int. Cl.

| | |
|---|---|
| ***F21V 14/08*** | (2006.01) |
| ***F21S 8/08*** | (2006.01) |
| ***F21S 9/02*** | (2006.01) |
| ***F21V 11/18*** | (2006.01) |
| ***F21V 21/08*** | (2006.01) |
| ***F21V 21/14*** | (2006.01) |

(Continued)

(52) U.S. Cl.

CPC ..... *F21V 14/08* (2013.01); *A63C 19/00* (2013.01); *F21S 8/086* (2013.01); *F21S 9/02* (2013.01); *F21V 11/18* (2013.01); *F21V 21/088* (2013.01); *F21V 21/0824* (2013.01); *F21V 21/14* (2013.01); *A63C 2203/14* (2013.01)

(58) Field of Classification Search

CPC ..... F21V 14/08; A60C 2203/14; F21S 8/086

See application file for complete search history.

(56) References Cited

U.S. PATENT DOCUMENTS

| | | | |
|---|---|---|---|
| 5,417,438 | A | 5/1995 | Poff |
| 5,436,811 | A | 7/1995 | Hecking |

(Continued)

FOREIGN PATENT DOCUMENTS

| | | | |
|---|---|---|---|
| CN | 104501049 | A | 4/2015 |
| EP | 0030740 | A2 | 6/1981 |

*Primary Examiner* — Bryon T Gyllstrom
*Assistant Examiner* — Christopher E Dunay
(74) *Attorney, Agent, or Firm* — Mandelbaum Silfin Economou LLP; John S. Economou

(57) ABSTRACT

A system for lighting a volleyball court has four corner light assemblies, two side center light assemblies, and four mid-court light assemblies. Each corner light assembly has an upper light fixture adapted to emit light outward and downward at a level generally below a player's eye level and a lower light element mounted in a manner to emit light outwards and upwards. Each side center light assembly has two lower light fixtures adapted to emit light outward and downward at a level generally below a player's eye level and an upper light assembly adapted to emit light outwards and upwards at a level generally above a player's eye level. Each mid-court light assembly has a light fixture adapted to emit light outward and downward at a level generally below a player's eye level. By ensuring that no light is emitted at a player's eye level, glare is significantly reduced.

62 Claims, 28 Drawing Sheets

Related U.S. Application Data which is a continuation of application No. 16/797,596, filed on Feb. 21, 2020, now Pat. No. 10,976,030.

(51) Int. Cl.
*A63C 19/00* (2006.01)
*F21V 21/088* (2006.01)

(56) References Cited

U.S. PATENT DOCUMENTS 5,653,640 A 8/1997 Shirley, Jr.
5,916,048 A 6/1999 Hurell et al.
6,561,678 B2 5/2003 Loughrey
6,575,853 B1 6/2003 O'Neill et al.
6,866,589 B1 * 3/2005 Widrick ..... A63C 19/10 472/90
7,182,480 B2 2/2007 Kan
8,297,792 B1 * 10/2012 Wang ..... F21S 8/086 362/249.03
8,690,715 B2 4/2014 Vogt
8,998,649 B2 4/2015 Lemons et al.
9,115,867 B2 8/2015 Gregoris
10,337,680 B1 * 7/2019 Gordin ..... F21V 21/116
2004/0124582 A1 7/2004 Oister et al.
2009/0129081 A1 * 5/2009 Gordin ..... F21S 2/00 362/235
2010/0110673 A1 5/2010 Bergman et al.
2012/0065006 A1 * 3/2012 Vogt ..... A63C 19/06 473/490
2014/0171234 A1 6/2014 Vogt
2014/0340889 A1 * 11/2014 Gordin ..... F21V 7/04 362/231
2015/0034807 A1 * 2/2015 Lobbert ..... G01J 1/44 250/214.1
2015/0113842 A1 4/2015 Suhr
2015/0334807 A1 * 11/2015 Gordin ..... F21V 23/0464 315/152
2017/0102117 A1 * 4/2017 Cordova ..... F21S 8/085

* cited by examiner

PORTABLE BEACH VOLLEYBALL LIGHTING SYSTEM

FIELD

This disclosure relates generally to an outdoor sports lighting system and more specifically it relates to a portable volleyball lighting system for use outdoors on a beach or other venue.

BACKGROUND

Volleyball is unique among sports in that most of action occurs in the air, above the head of every player. In an indoor venue or during the day, it is not difficult to keep track of the flight of the ball as it moves in the air between each side of the net as players on each team take turns in striking the ball. However, volleyball, and beach volleyball in particular, is often played outside at night under artificial lighting. Conventional artificial lighting systems for outdoor sports consist of a number light assemblies positioned high above the playing surface on poles mounted around the court, with each of the light assemblies aimed to emit light down at the playing surface. These systems have a number of drawbacks when used for outdoor beach volleyball. First and foremost, a volleyball player will often lose track of the flight of the ball due to glare from one or more of the light assemblies shining in their eyes. In addition, volleyball players can also lose track of the flight of the ball when the ball moves into darkness above the height of the pole-mounted light assemblies. Further, shadows cast by the ball as it moves in the air between each side of the net can be distracting to the volleyball players.

Beach volleyball has become quite popular world-wide, and courts can be set up quickly on any available open beach area using portable net systems. However, there are presently no available portable lighting systems for beach volleyball, so that nighttime beach volleyball is presently limited to dedicated courts having permanent lighting installations.

Accordingly, there is a need for improved lighting systems for outdoor beach volleyball that overcomes the problems recited above.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

The present disclosure is addressed to various embodiments of a volleyball lighting system that provide distributed aerial lighting above and on the volleyball court in order to keep the volleyball itself and the volleyball court boundaries illuminated at all times. Three different types of light assemblies are disclosed, with each lighting element preferably including a glare protector to eliminate glare and to reduce shadows on the volleyball court surface, including a first (corner) light assembly, a second (side center) light assembly, and a third (mid-court) light assembly which are arranged around the perimeter of the volleyball court to provide lighting thereto, each with light emitting elements arranged to emit light in a pattern generally above the eye level of the tallest player on the volleyball court and/or light emitting elements arranged to emit light in a pattern generally below the average eye level of the shortest volleyball player on the court.

Figure 1A:
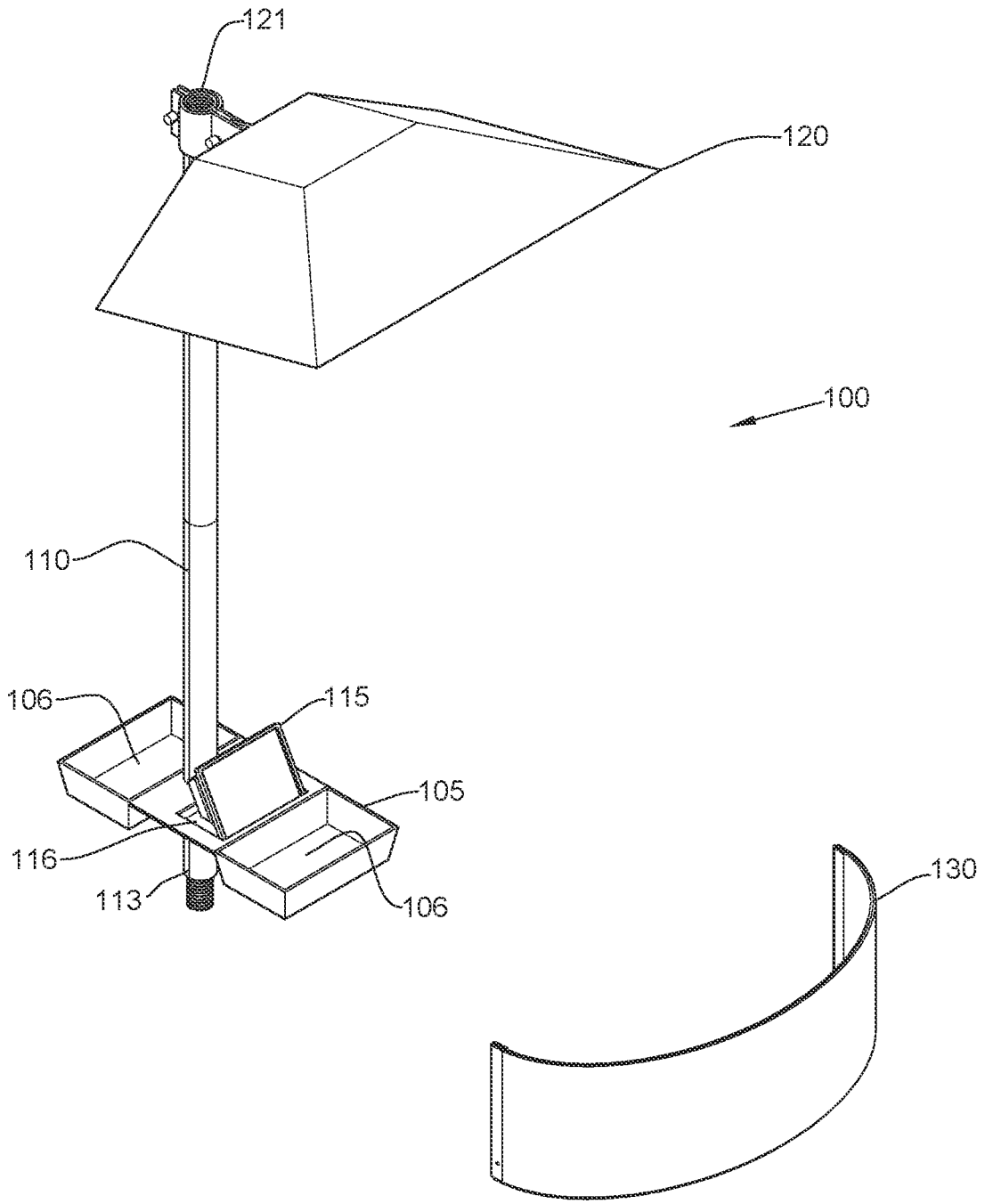
FIG. 1A is a top front side view of a corner light assembly according to the present disclosure.
Figure 1B:
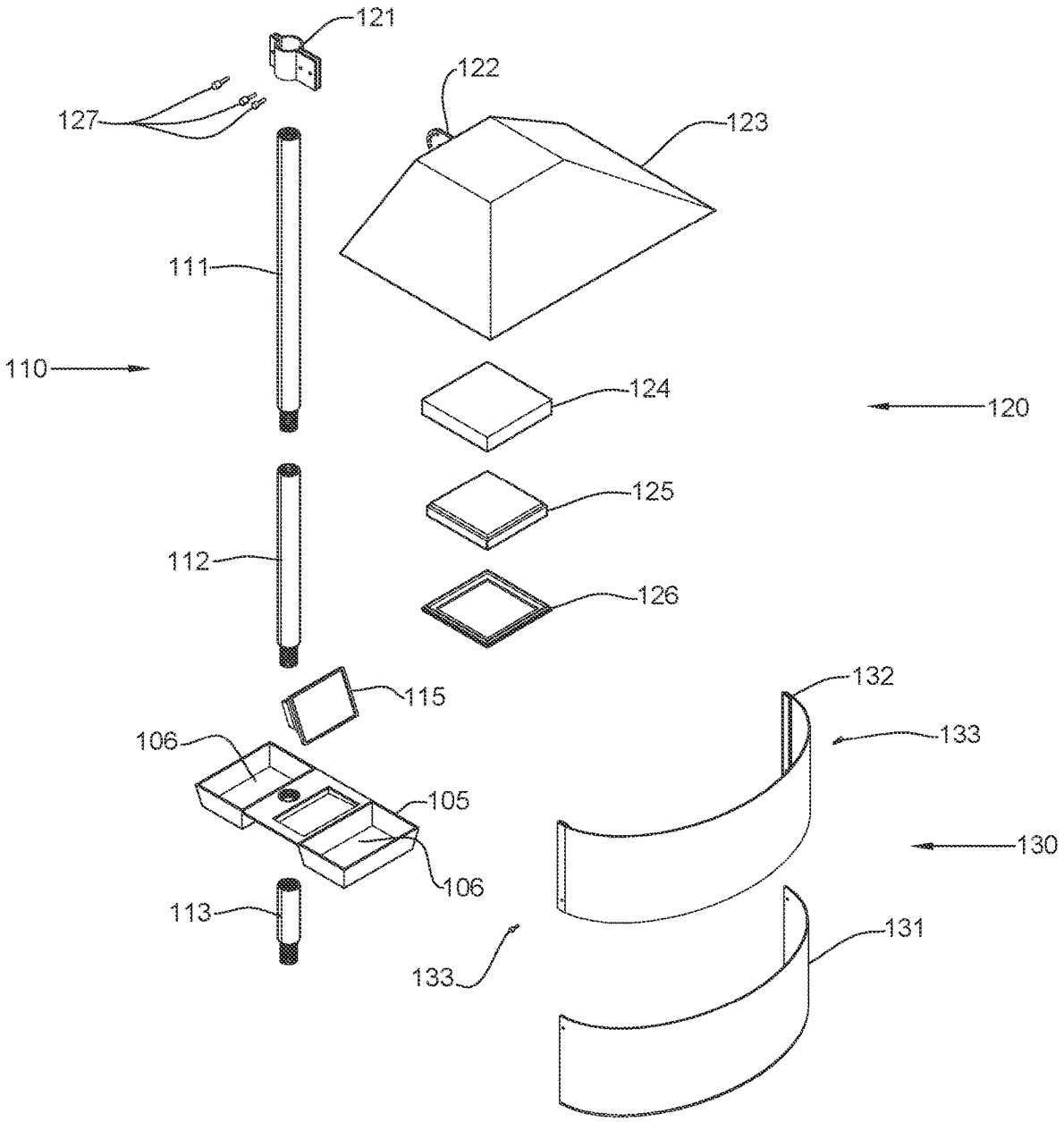
FIG. 1B is an exploded top front side view of the corner light assembly.

Referring now to FIGS. 1A and 1B, each corner light assembly 100 includes a base portion 105, a vertical support pole 110 fixedly mounted to base portion 105 via threads in a lower portion thereof that mate with a threaded aperture in base portion 105, a lower light emitting element 115 mounted in a slot 116 on base portion 105, and an upper light fixture 120. Vertical support pole 110 may be fixedly secured to the base portion 105 in other ways, e.g., via pins passing through apertures in the vertical support pole 110 and a collar formed in an aperture in the base portion 105. Lower light emitting element 115 includes an integral high output light emitting element which is preferably battery-powered, but alternatively may be powered via a power cord that connects conventionally to an available electrical outlet (or portable power supply/generator). Vertical support pole 110 is preferably formed from two portions 111 and 112 which thread together in a conventional manner. A below ground member 113 is optionally coupled to a lower surface of base portion 105 (e.g., by threads that mate with threads on a bottom portion of vertical support pole 110 that pass through base portion 105) in order to better secure the base portion 105 when corner light assembly 100 is mounted in sand as is normally present at a beach. Base portion 105 preferably includes front and back cavities 106 that may be filled with sand or other material in order to better secure the corner light assembly 100 to the ground during use. In a first embodiment, a corner light assembly 100 is placed outside of each corner of the volleyball court, as shown in FIGS. 4 and 5. Upper light fixture 120 is shown in more detail in FIG. 1B, and includes a hood 123, a clamp mechanism 121 for connection to the top of the vertical support pole 110 via mating hardware 127 (e.g., nuts and bolts), an adjustment mechanism 122 mounted on hood 123 which provides an adjustable coupling to clamp mechanism 121, and a light emitting element 125 mounted to an inner surface of the hood 123 via a casing 124 and a flange 126. Light emitting element 125 is also an integral high output light emitting element which is preferably battery-powered, but alternatively may be powered via a power cord that connects conventionally to an available electrical outlet.

Figure 2:
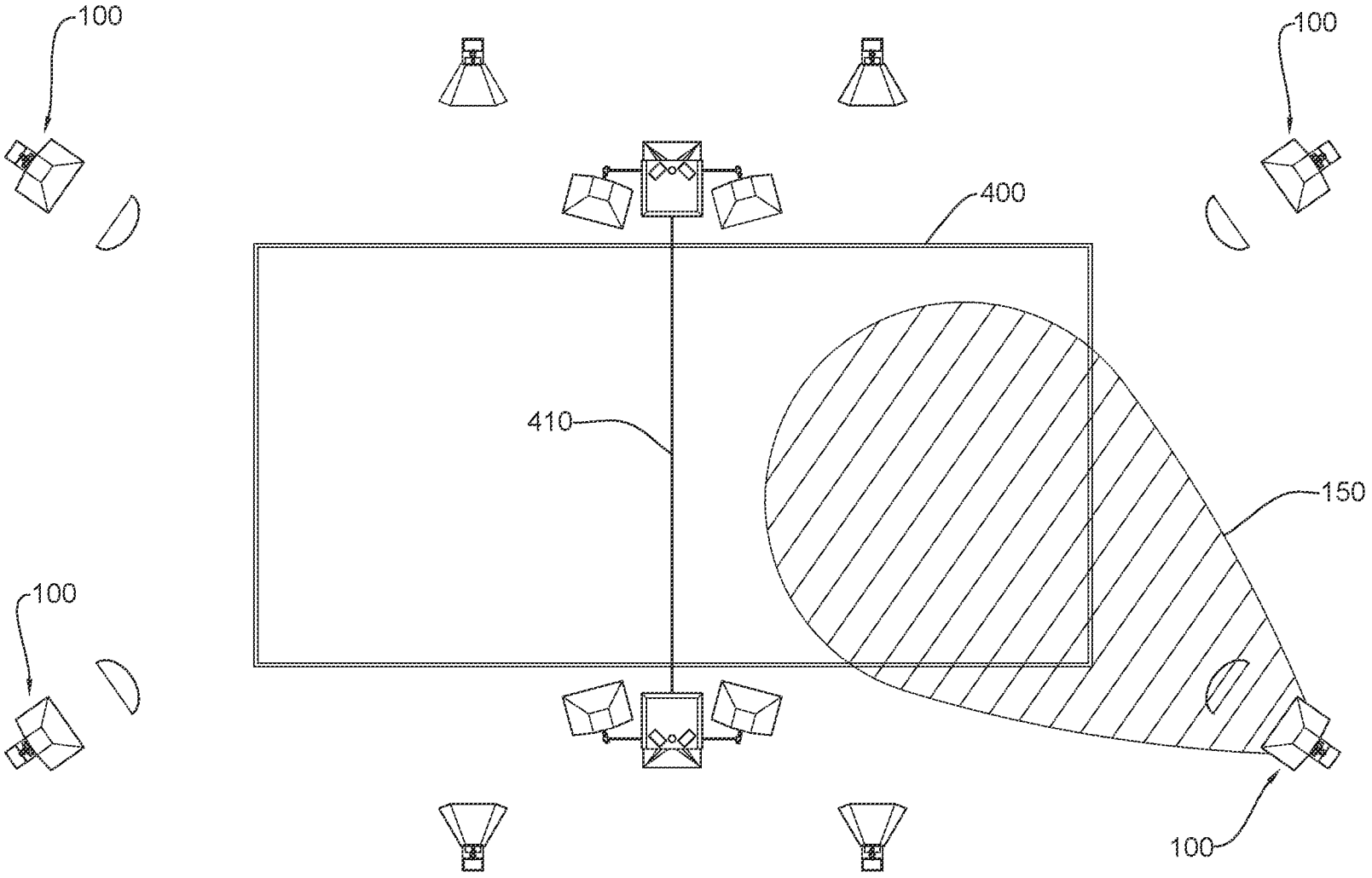
FIG. 2 is a top view of a volleyball court showing the light pattern dispersed from one of the light emitting elements on the corner light assembly.
Figure 3A:
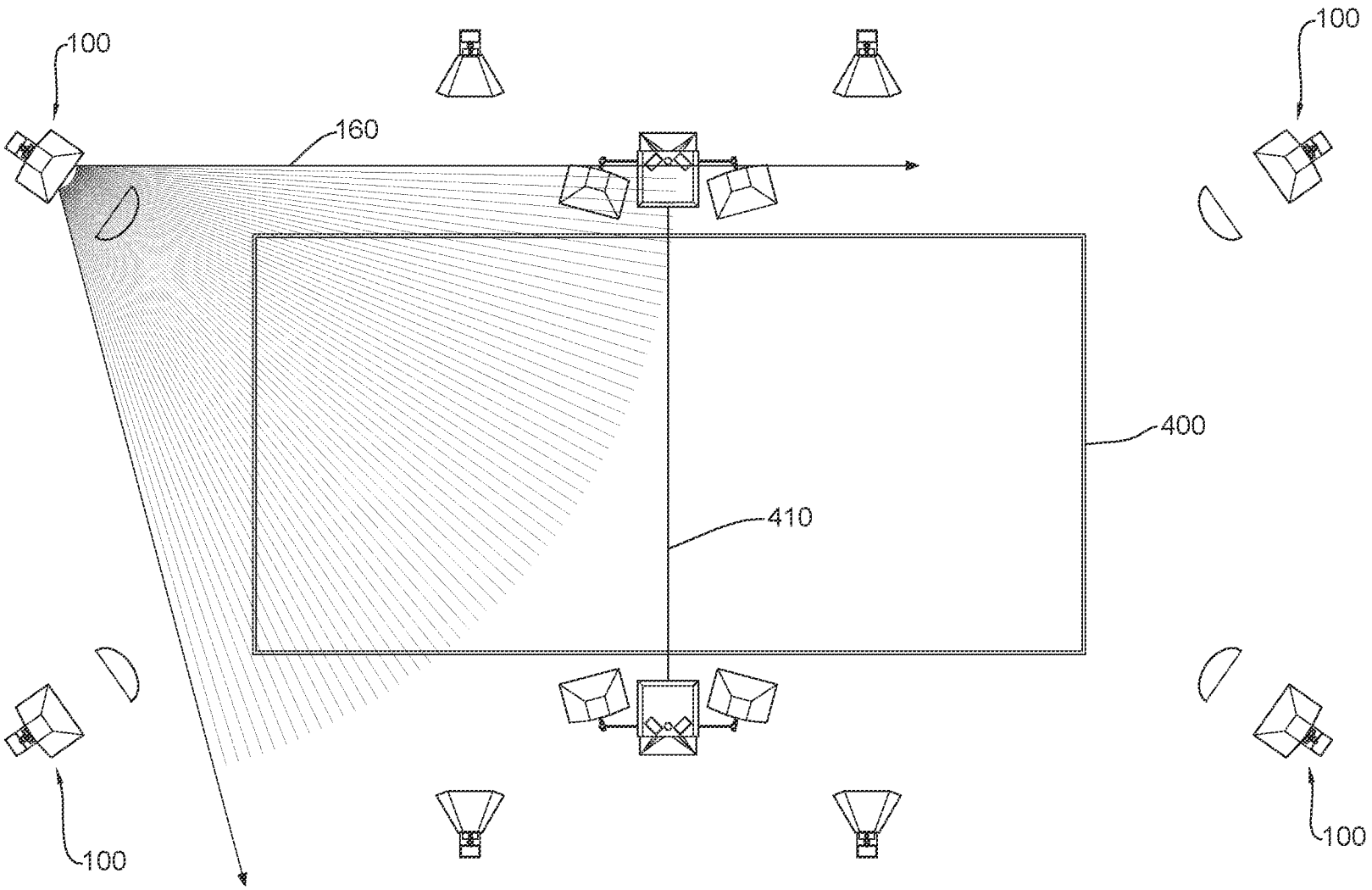
FIG. 3A is a top view of a volleyball court and FIG. 3B is a side view of the volleyball court, each of FIG. 3A and FIG. 3B showing the light pattern dispersed from another of the light emitting elements on the corner light assembly.
Figure 3B:
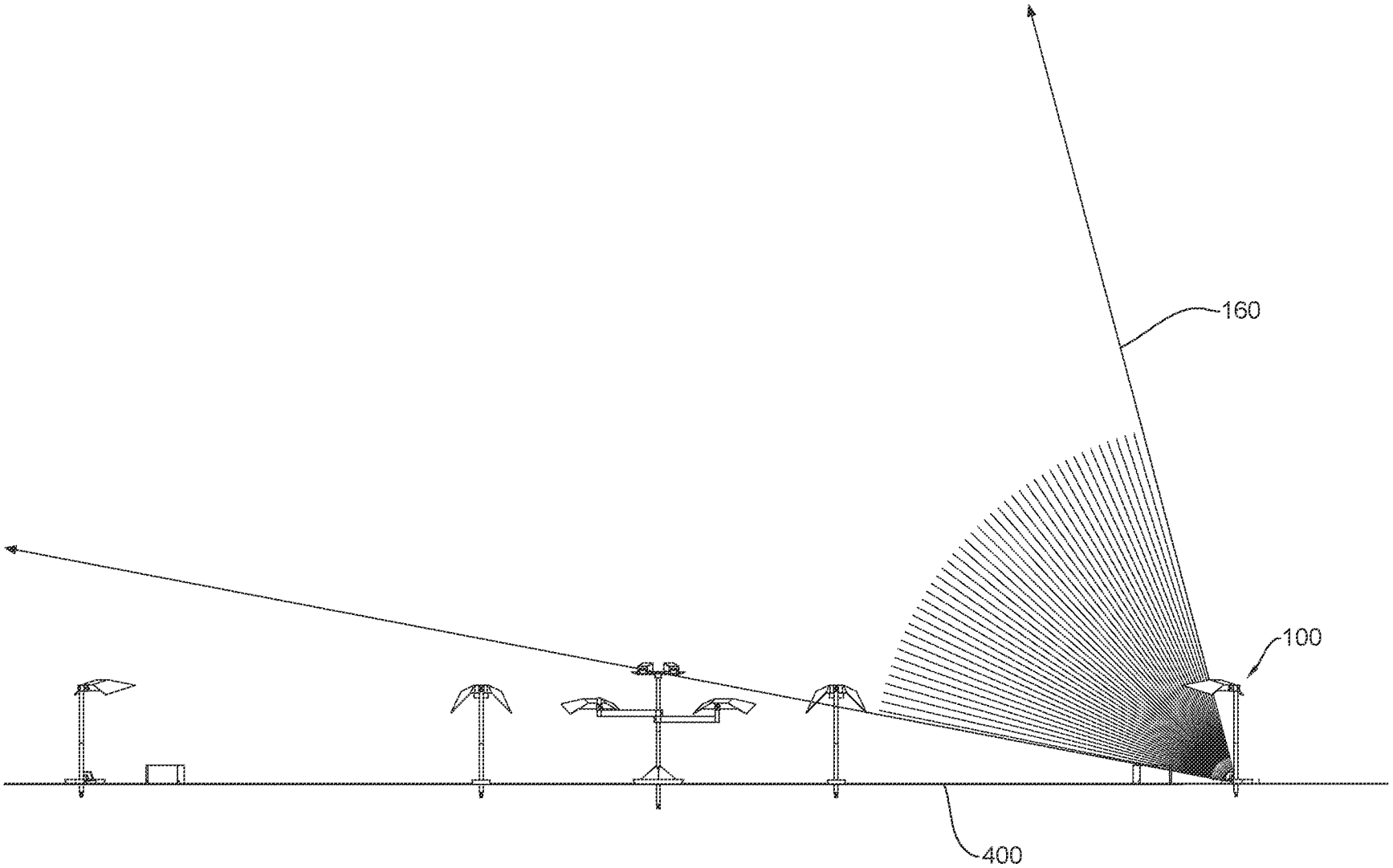

The adjustment mechanism 122 allows the hood 123 to rotate up and down in order to adjust how light emitted by light emitting element 125 is dispersed onto the volleyball court. In use, once a corner light assembly 100 is positioned at a corner of the volleyball court, the adjustment mechanism 122 on the upper light fixture 120 of the corner light assembly 100 is adjusted to so that light is emitted in a manner which illuminates the rear to mid portion of that corner of the volleyball court, and at a level generally below the eye level of the volleyball players in order to eliminate glare. The light path 150 for the light emitting element 125 is shown in FIG. 2. Lower light emitting element 115 emits light generally upwards and outward in order to light the lower side of a volleyball in flight. The light path 160 for the lower light emitting element 115 is shown in FIGS. 3A and 3B.

A separate glare protector 130 may be provided which includes a horizontal base portion (not shown), a lower fixed vertical curved portion 131, and an upper adjustable vertical curved portion 132. The upper adjustable vertical curved portion 132 may be moved up and down (and secured in place by screws 133 once a final position is found) to ensure that the light emitted by lower light emitting element 115 does not cause glare in the eyes of the volleyball players. Likewise, glare protector 130 may be moved closer or further from corner light assembly 100 in order to control the dispersal of light and to ensure that no light is emitted at a player's eye level. Alternatively, a glare protector providing the same functionality as glare protector 130 may be integrated directly onto the base portion 105.

When the corner light assemblies 100 are positioned at each corner of a beach volleyball court, the upper light fixtures 120 will emit light generally horizontally and below horizontal, allowing the players to see their position on the volleyball court in relation to other players, the net, and the volleyball court boundaries, without ever being subjected to glare from the upper light fixtures. In addition, the lower light fixtures 115 will emit light upwards and outward—illuminating a lower portion of the volleyball in flight, with the light generally above the eye level of the players and eliminating glare from lower light fixtures 115 when each glare protector 130 is positioned properly. In some cases, the use of the four corner light assemblies 100 alone will provide acceptable lighting for a night-time beach volleyball game. This embodiment can be useful for practice, novice players, or informal non-competitive games, for example.

Figure 1C:
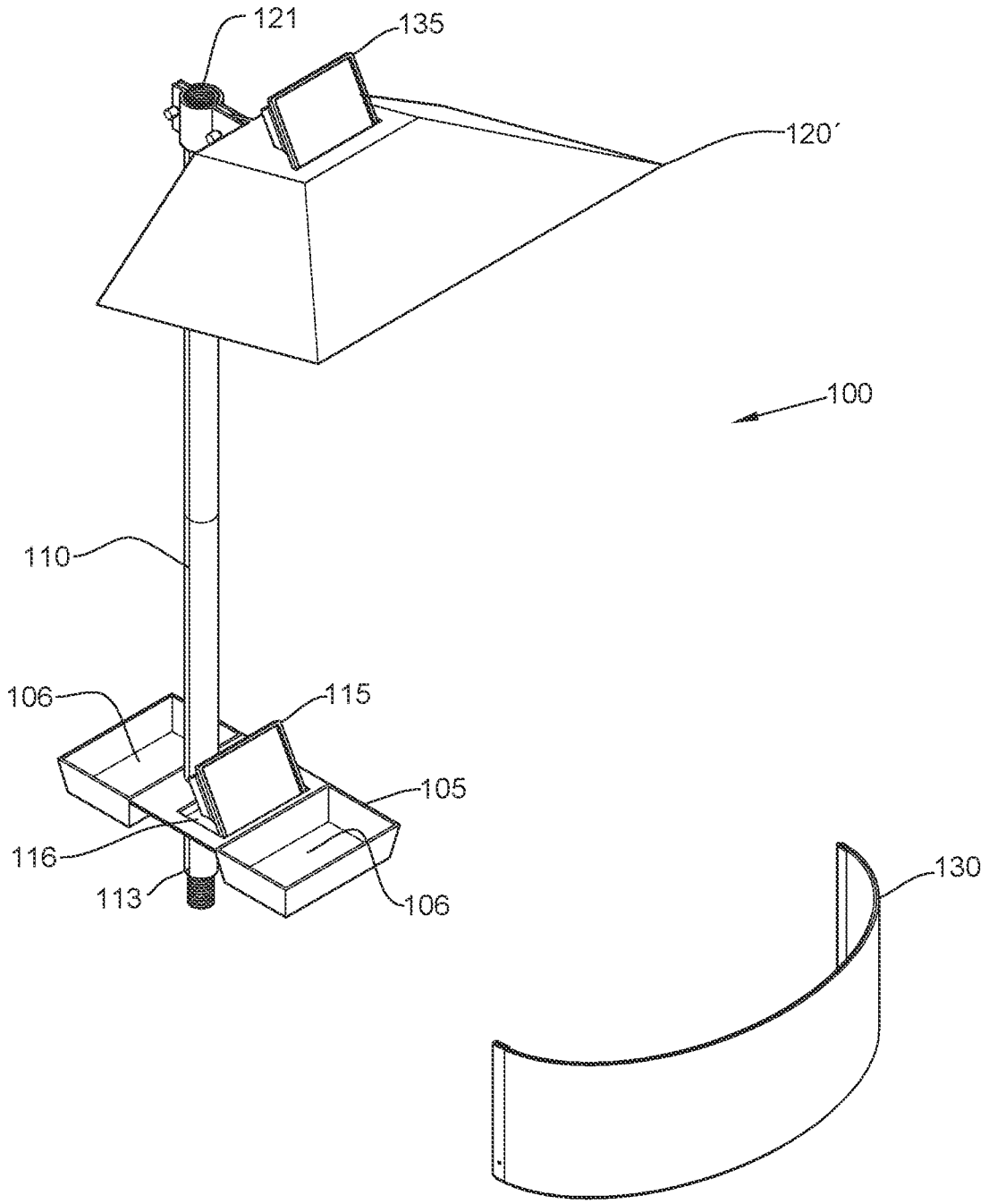
FIG. 1C is an alternative embodiment of the corner light assembly of FIG. 1A.

In a further embodiment shown in FIG. 1C, an upper light fixture 120' includes a second light fixture 135 mounted on the top surface thereof. In this embodiment, the second light fixture 135 is positioned to direct light upwards, with the light generally above the eye level of the players and thereby eliminating glare in the eyes of the players. This further embodiment supplements the light from lower light fixture 115 and provides additional light in the rear portions of the volleyball court in the areas above the eye level of the players.

Figure 4A:
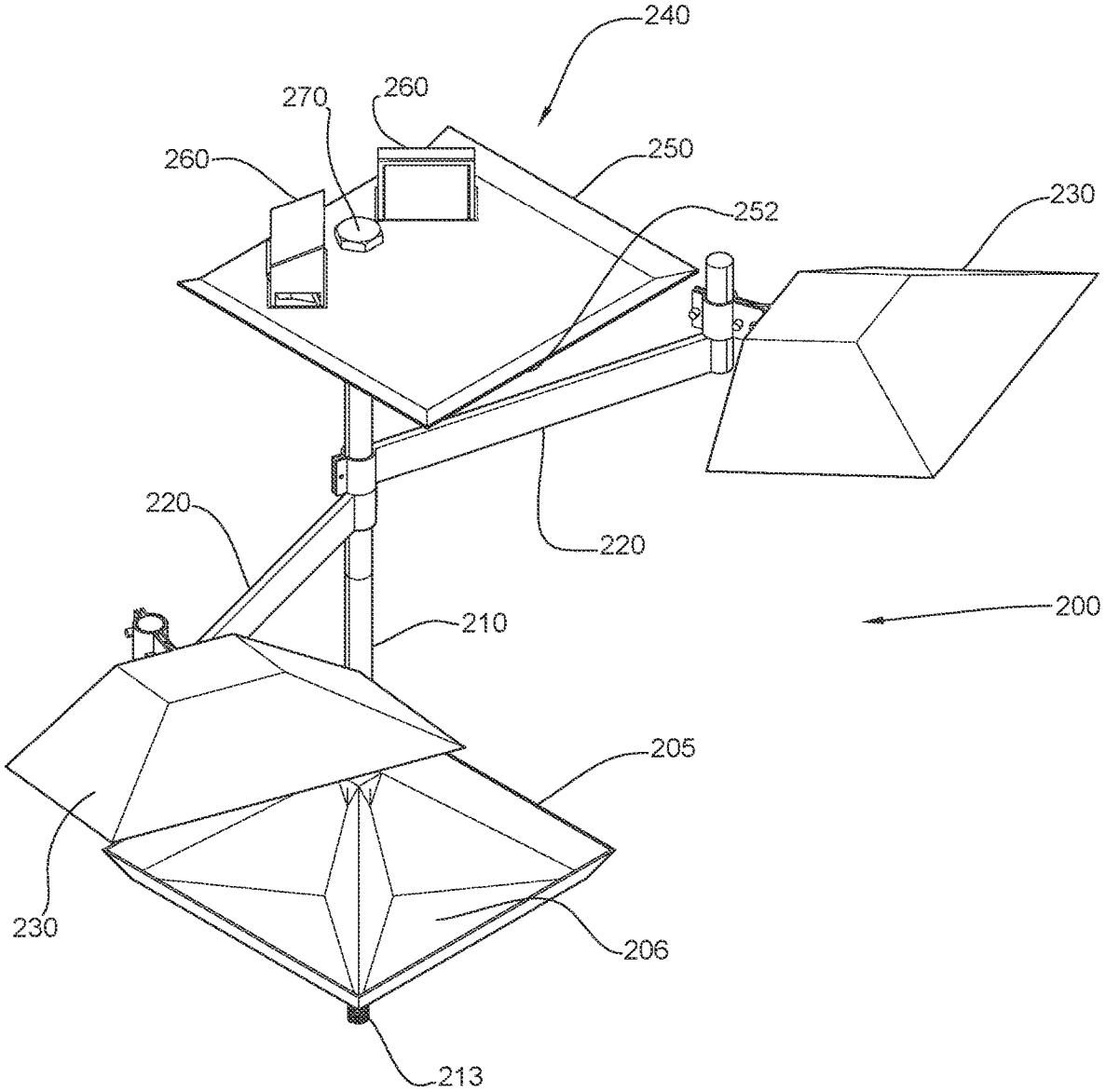
FIG. 4A is a top front side view of a side center light assembly according to the present disclosure.
Figure 4B:
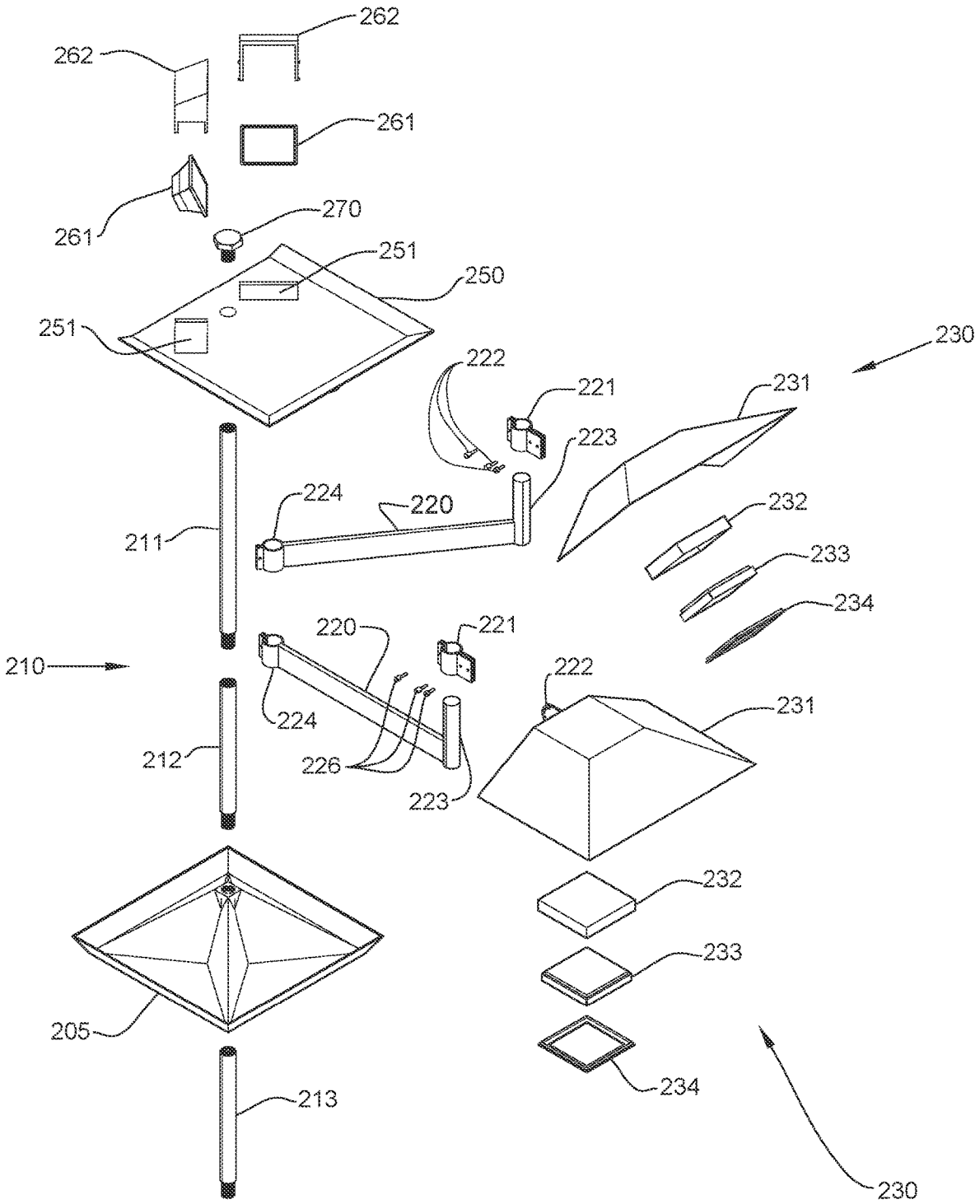
FIG. 4B is an exploded top front side view of the side center light assembly.
Figure 4C:
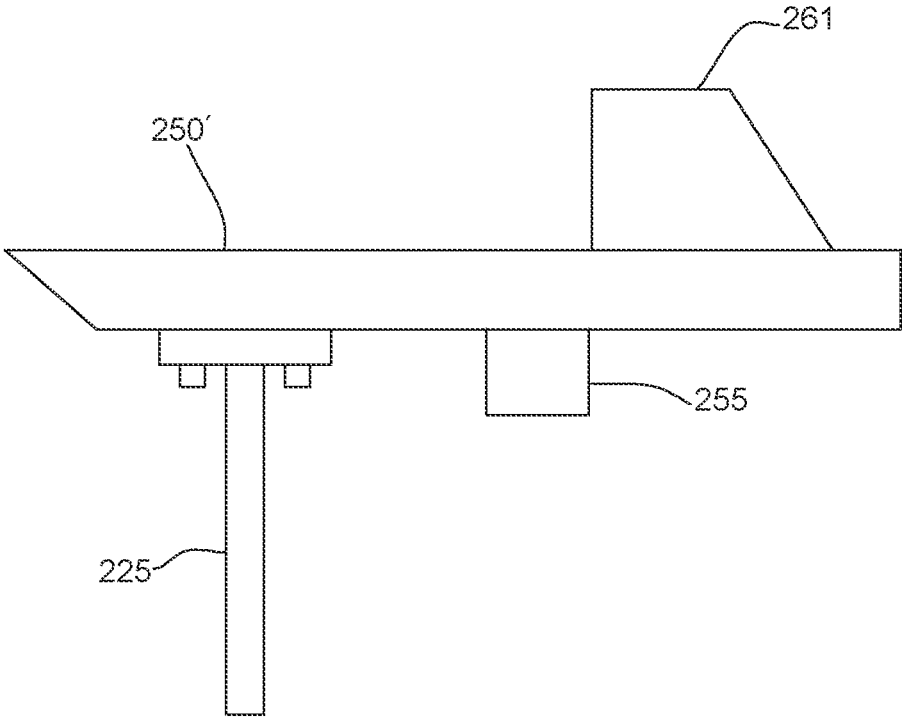
FIG. 4C is a side view of an alternative embodiment for the upper platform of the side center light assembly of FIG. 4A.
Figure 5:
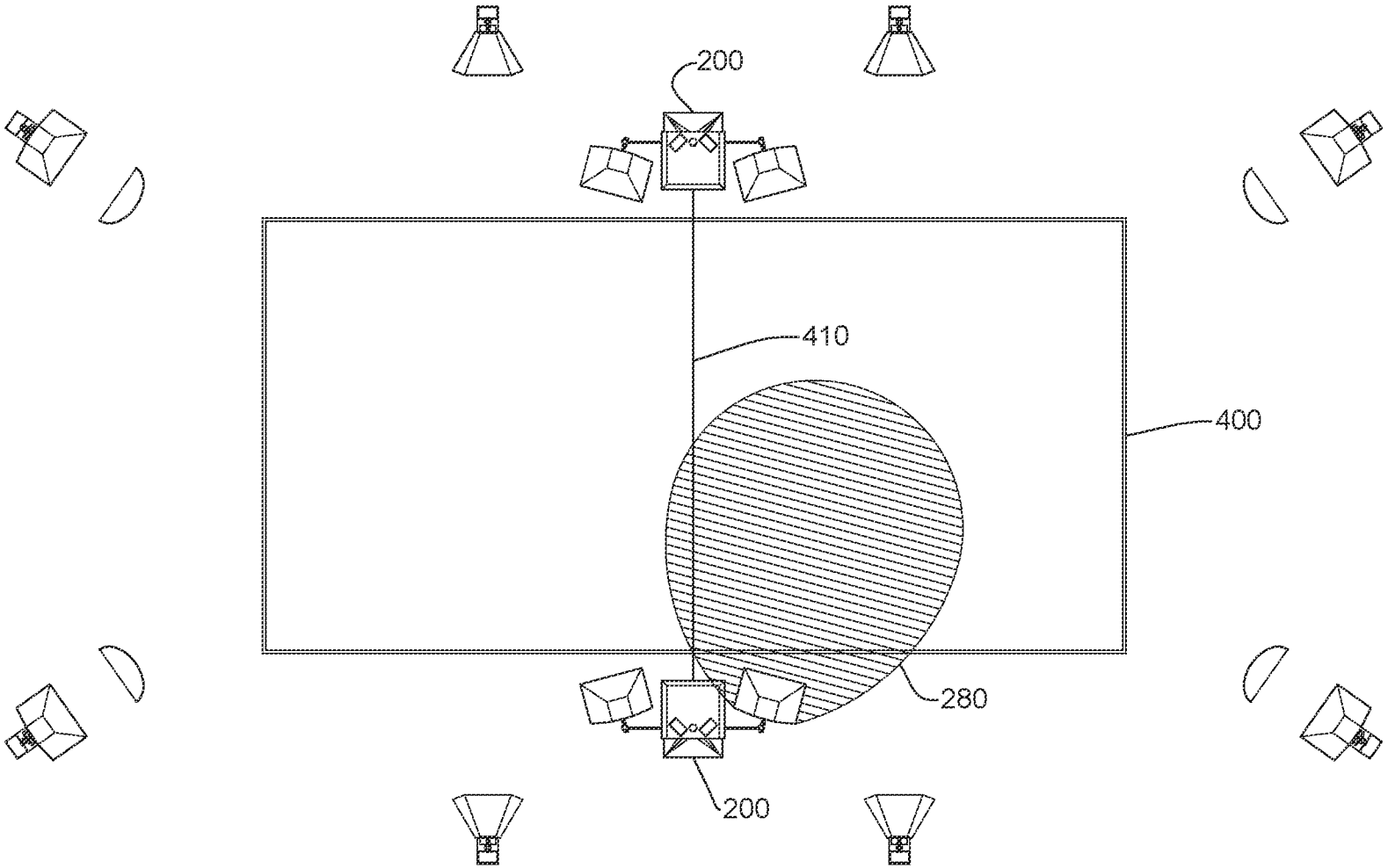
FIG. 5 is a top view of a volleyball court showing the light pattern dispersed from one of the light emitting elements on the side center light assembly.

In a second embodiment, two side center light assemblies 200 may be provided in a position directly adjacent to a respective one of the two support poles holding up the volleyball net (as shown in FIGS. 4 and 5). Each side center light assembly 200, as shown in FIGS. 4A and 4B, includes a base portion 205, a vertical support pole 210 fixedly mounted to base portion 205 via threads in a lower portion thereof which mate with a threaded aperture in base portion 205, two separate bracket arm assemblies 220 affixed to vertical support pole 210 via a clamping element 224 at a first end thereof, two separate lower light fixtures 230 affixed to vertical support pole 210 via a respective one of the bracket arm assemblies 220 (as discussed below), and an upper light assembly 240. Vertical support pole 210 may be fixedly secured to the base portion 205 in other ways, e.g., via pins passing through apertures in the vertical support pole 210 and a collar formed in an aperture in the base portion 205. In an alternative embodiment, the vertical support pole 210 of each side center light assembly 200 may also hold up the volleyball net, eliminating the need for a separate support pole on each side of the net. In this alternative embodiment, the base portion 205 may be eliminated when the volleyball net support lines provide adequate stability for each vertical support pole 210. Base portion 205 preferably includes four cavities 206 on each side that may be filled with sand or other material in order to better secure side center light assembly 200 to the ground during use. A below ground member 213 is optionally coupled to a lower surface of base portion 205 (e.g., by threads that mate with threads on a bottom portion of vertical support pole 210 that pass through base portion 205), also used to better secure the base portion 205 when side center light assembly 200 is mounted in sand as is normally present at a beach.

Upper light assembly 240 consists of an upper platform 250 which is coupled to vertical support pole 210 via a connecting mechanism 270 (e.g., a bolt that threads into internal threads at the top of vertical support pole 210), and two separate upper light modules 260. The upper platform 250 may include a downward facing slot 252 (partially shown in FIG. 4A) (e.g., a cylindrical slot) that slides over the top portion of the adjacent volleyball net pole for added support of side center light assembly 200. Each upper light module 260 consists of a light fixture 261 and a bracket 262 for securing light fixture 261 into a slot 251 on upper platform 250. Each light fixture 261 includes an integral high output light emitting element which is preferably battery-powered, but alternatively may be powered via a power cord that connects conventionally to an available electrical outlet. Each upper light module 260 is positioned at the rear of upper platform 250 to project light outwardly and upwardly, and only above a horizontal line parallel to the surface of upper platform 250 (upper platform 250 prevents any light from the upper light modules 260 from being projected below the height of upper platform 250) in order to ensure that such light does not shine or otherwise glare into the eyes of players on the volleyball court.

Each lower light fixture 230 is shown in more detail in FIG. 4B, and includes a hood 231, a clamp mechanism 221 for connection to a projecting member 223 at a second end of an associated one of the bracket arm assemblies 220 (opposite to the first end) via mating hardware 226 (e.g., nuts and bolts), an adjustment mechanism 222 mounted on hood 231 which provides an adjustable coupling to clamp mechanism 221, and a light emitting element 233 mounted to an inner surface of the hood 231 via a casing 232 and a flange 234. Light emitting element 233 is also an integral high output light emitting element which is preferably battery-powered, but alternatively may be powered via a power cord that connects conventionally to an available electrical outlet.

Figure 6A:
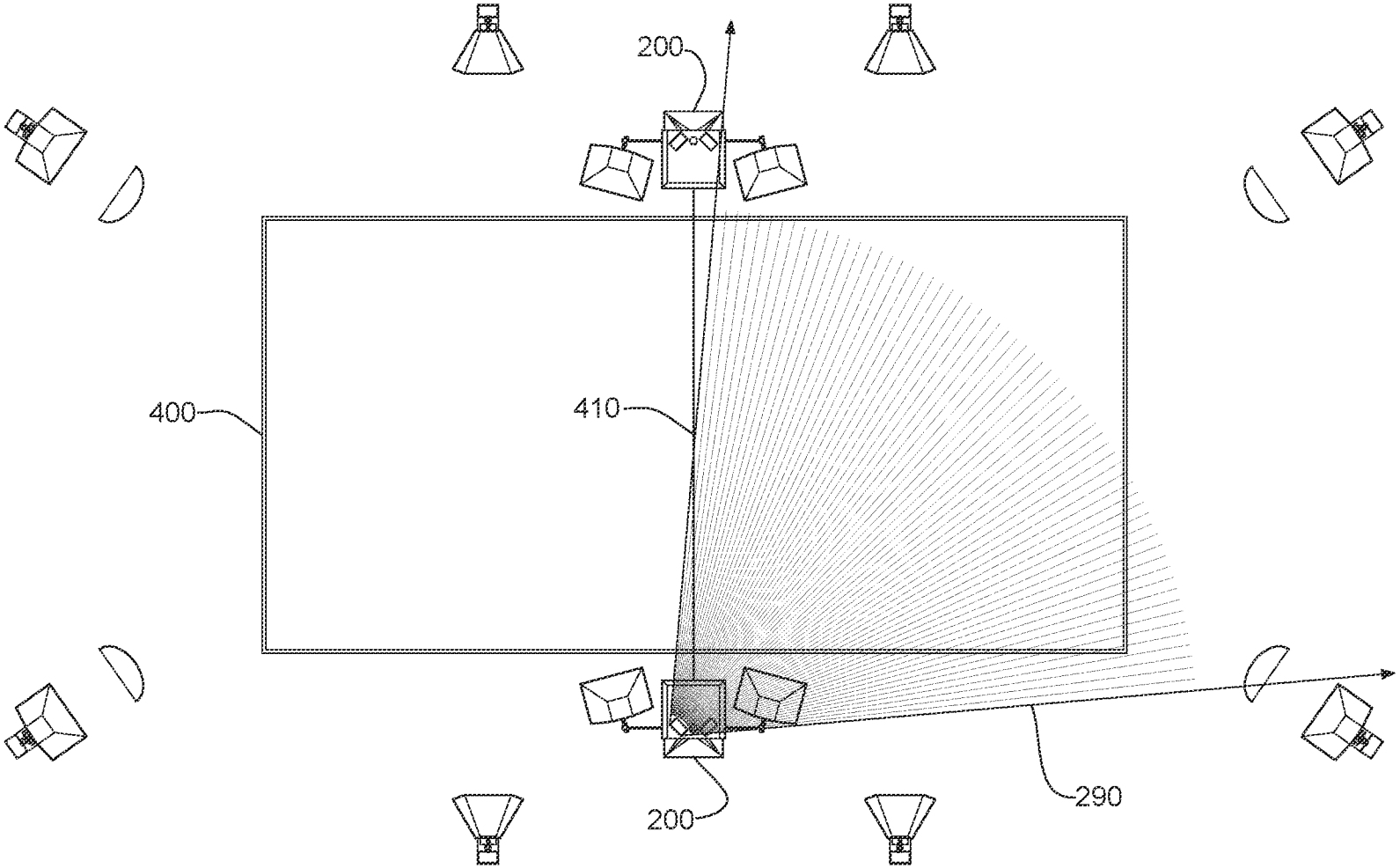
FIG. 6A is a top view of a volleyball court and FIG. 6B is a side view of the volleyball court, each of FIG. 6A and FIG. 6B showing the light pattern dispersed from another of the light emitting elements on the side center light assembly.
Figure 6B:
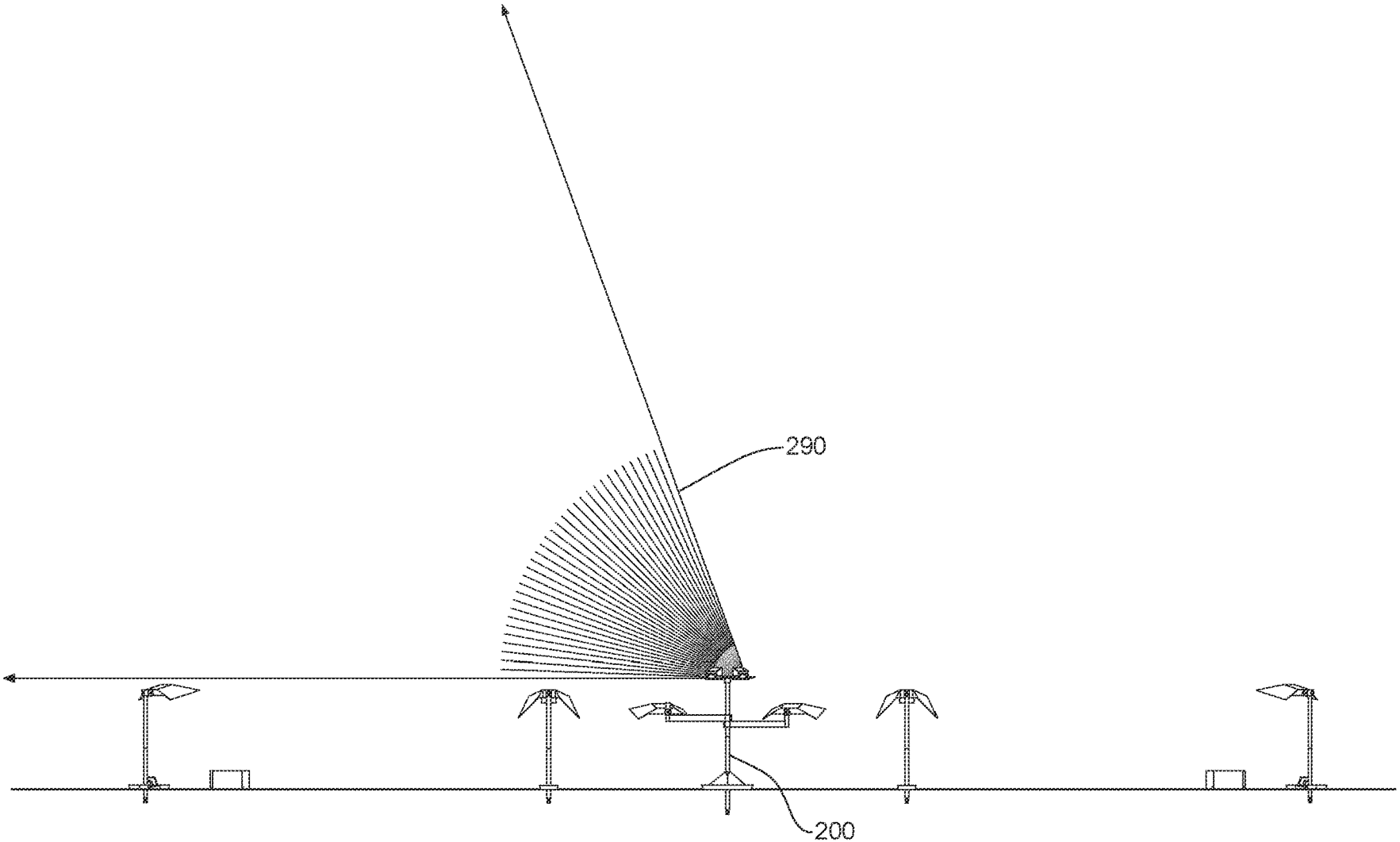

The adjustment mechanism 222 allows the hood 231 to rotate up and down in order to adjust how light emitted by light emitting element 233 is dispersed onto the volleyball court. In use, once a side center light assembly 200 is positioned at adjacent to one of the poles holding up the net at the center of the volleyball court, the adjustment mechanism 222 on each lower light fixture 230 of that side center light assembly 200 is adjusted to so that light is emitted in a manner which illuminates the center to mid portion of the associated side of the volleyball court, and at a level generally below the eye level of the volleyball players in order to eliminate glare. The light path 280 for one of the light emitting elements 233 is shown in FIG. 5. The two upper light modules 260 each emits light generally upwards and outward in order to light the lower side of a volleyball in flight, particularly in the area adjacent to the associated side and center portion of the volleyball court. As explained above, by placing the two upper light modules 260 at the rear of upper platform 250, none of the light emitted by such modules will shine or otherwise glare into the eyes of the volleyball players, because upper platform, positioned above the height of the players, will act as a shield to block any light from such modules from projecting downward below the height of upper platform 250. The light path 290 for one of the light emitting modules 260 is shown in FIGS. 6A and 6B.

By adding a side center light assembly 200 on each side of a volleyball court (directly adjacent to each volleyball net pole, as shown in FIGS. 4 and 5), to the four corner light assemblies 100 in each corner of the volleyball court, additional lighting will be provided generally above and below the eye level of a player in the area adjacent to the net. This combination provides an enhanced experience in playing volleyball on a beach, as may be required by more competitive players and mid-level competition.

In an alternative embodiment shown in FIG. 4C, the two lower light fixtures 230 may be mounted directly to respective arm members 225 (i.e., via clamp mechanism 221) which in turn are attached to the lower portion of upper platform 250'. In this alternative embodiment, the two bracket arm assemblies 220 may be omitted. Upper platform 250' includes a mounting collar 255 which fits over the top end of pole 210. Upper platform 250' may be secured to pole 210 in a conventional manner such as a set screw passing through a threaded hole in mounting collar 255 or a pin that passes through holes in both the mounting collar 255 and the pole 210.

Figure 7A:
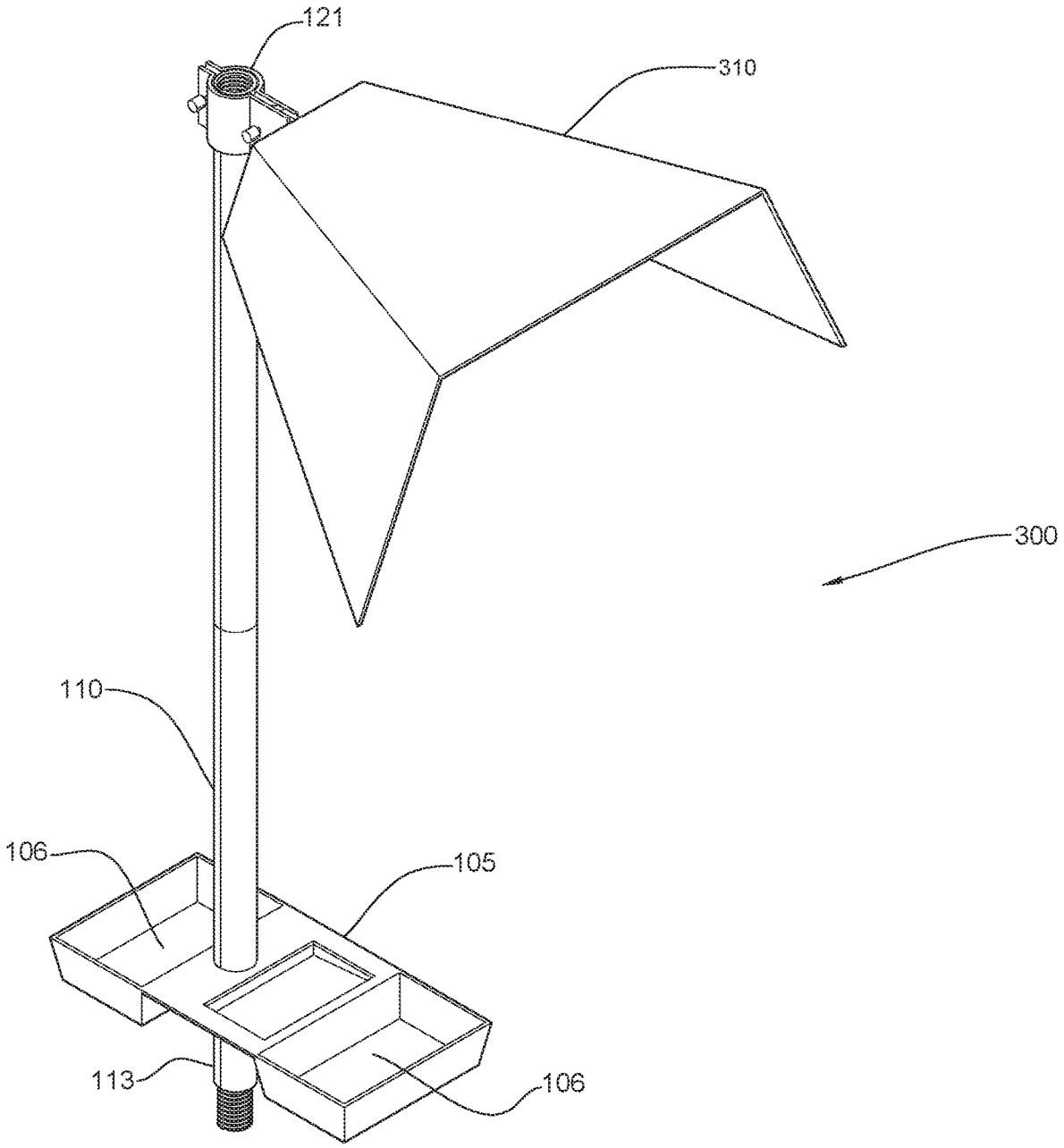
FIG. 7A is a top front side view of a mid-court light assembly according to the present disclosure.
Figure 7B:
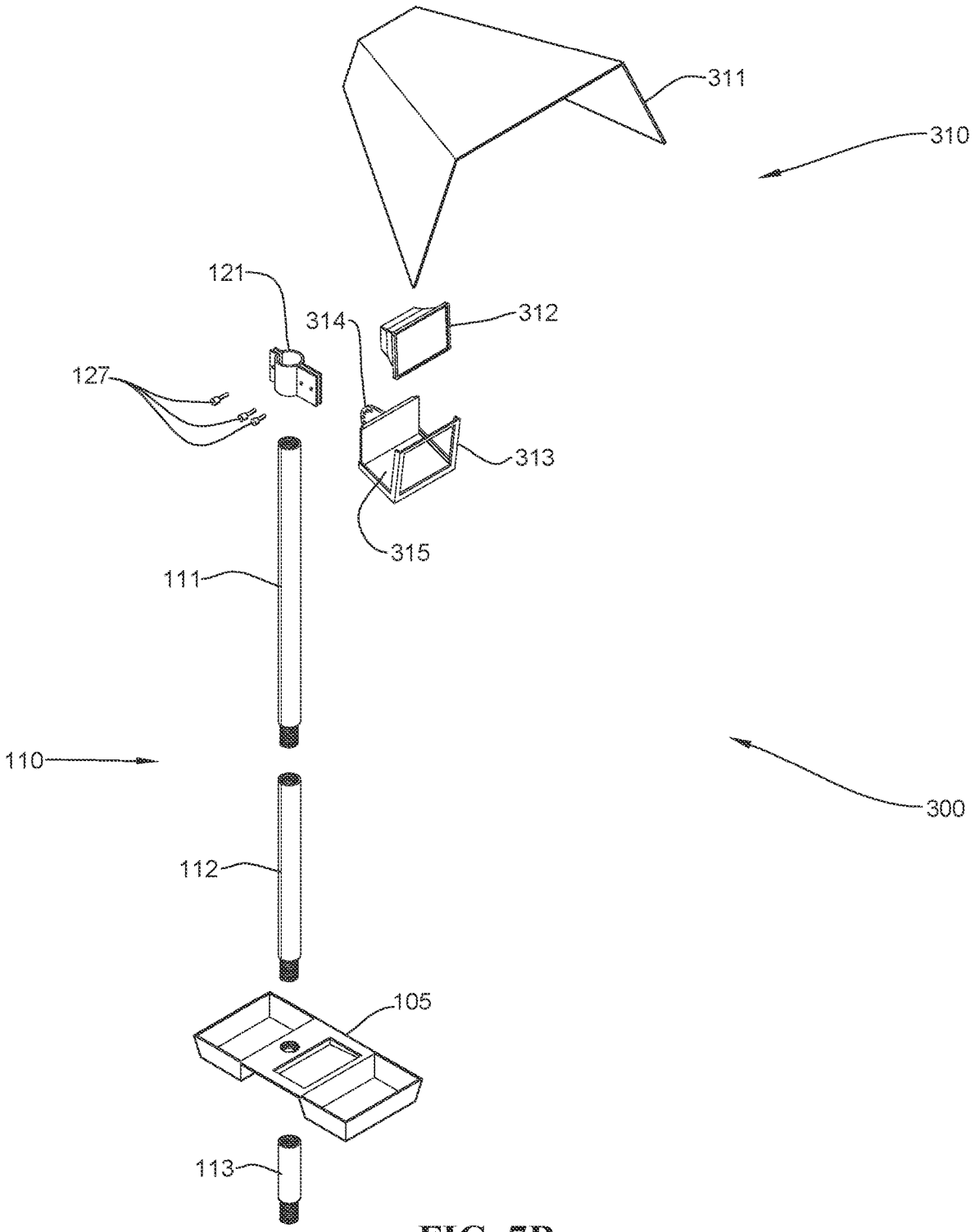
FIG. 7B is an exploded top front side view of the mid-court light assembly.

Referring now to FIGS. 7A and 7B, a mid-court light assembly 300 is shown. As shown in FIGS. 4 and 5, four mid-court light assemblies 300 are provided in a third embodiment, each mid-court light assembly 300 being placed on a side of the volleyball court at a point halfway between a side center court assembly 200 and a corner light assembly 100. Each mid-court assembly 300 is configured similarly to a corner light assembly 100, but with a different light assembly (i.e., light fixture 310) mounted at a top end of vertical support pole 110 and no lower light fixture mounted to base portion 105. As with corner light assembly 100, vertical support pole 110 may be fixedly secured to the base portion 105 via matching threads or in other ways, e.g., via pins passing through apertures in the vertical support pole 110 and a collar formed in an aperture in the base portion 105. Light fixture 310 is shown in expanded form in FIG. 7B and includes a hood 311, a light emitting element 312 and a bracket assembly 313. Bracket assembly 313 includes an adjustment mechanism 314 mounted on a rear portion thereof which provides an adjustable coupling to clamp mechanism 121. Light emitting element 312 slides into a front slot 315 of bracket assembly 313 and hood 311 slides down over bracket assembly 313 and is mated thereto in a conventional manner. Light emitting element 312 includes an integral high output light emitting element which is preferably battery-powered, but alternatively may be powered via a power cord that connects conventionally to an available electrical outlet.

Figure 8A:
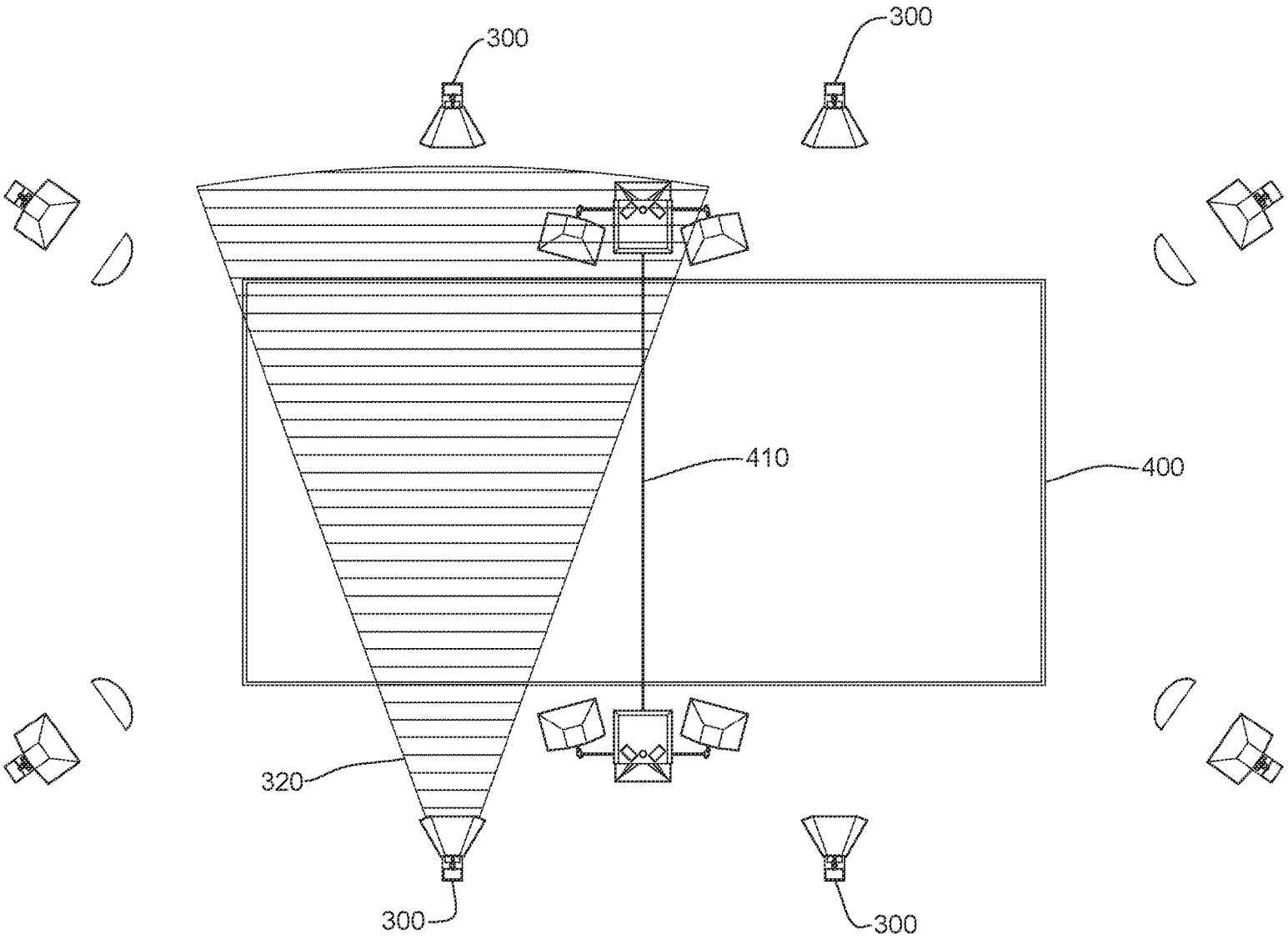
FIG. 8A is a top view of a volleyball court showing the light pattern dispersed from the light element on the mid-court light assembly.
Figure 8B:
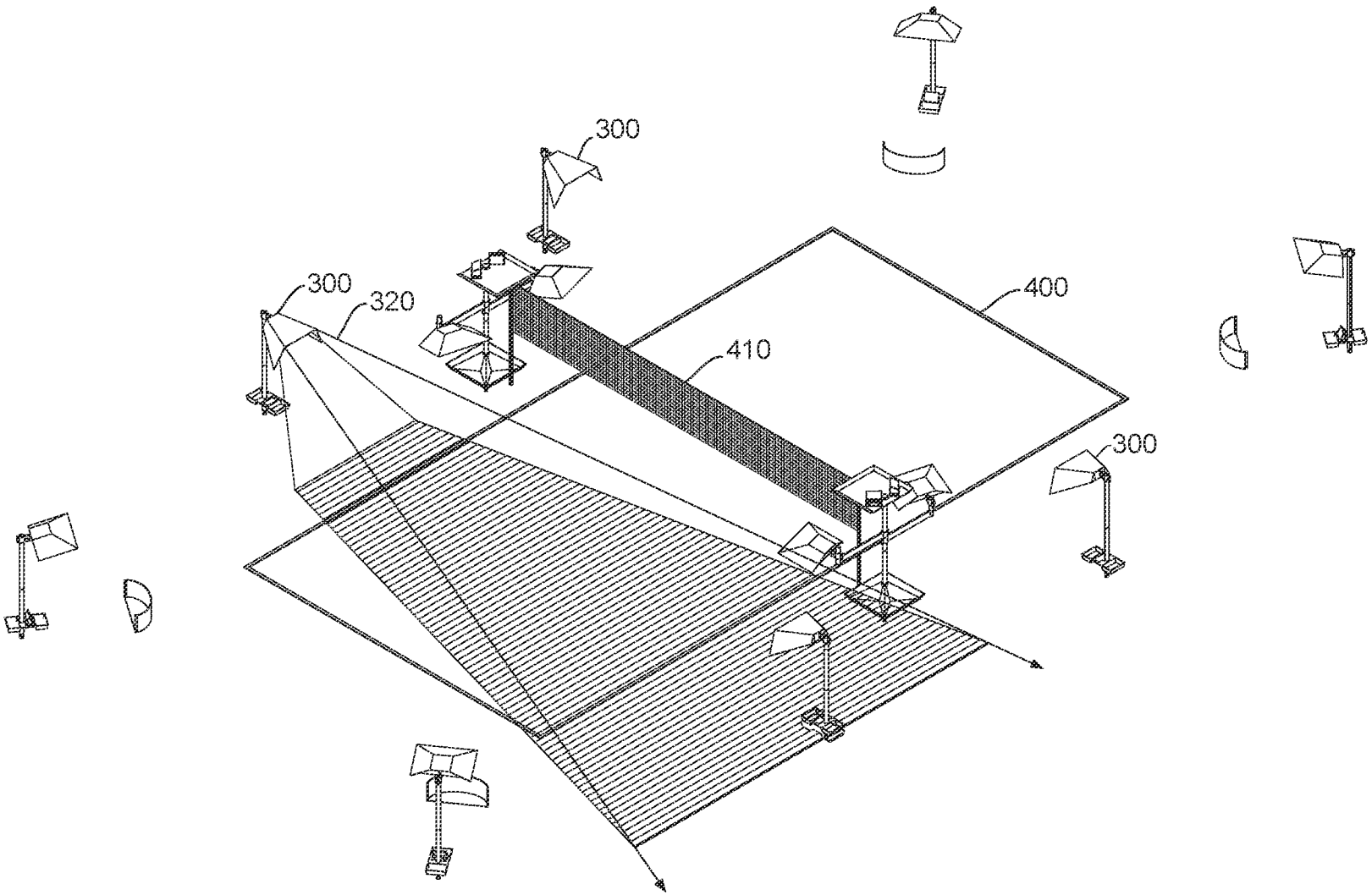
FIG. 8B is top front side view of a volleyball court showing the light pattern dispersed from the light element on the mid-court light assembly.

The adjustment mechanism 314 allows the hood 311 to rotate up and down in order to adjust how light emitted by light emitting element 312 is dispersed onto the volleyball court. In use, once a mid-court light assembly 300 is positioned as shown in FIGS. 4 and 5, the adjustment mechanism 314 is adjusted to so that light is emitted in a manner which illuminates the adjacent area of the volleyball court but at a level generally below the eye level of the volleyball players in order to eliminate glare. The light path 320 for one of the light emitting element 312 is shown in FIGS. 8A and 8B.

By adding four mid-court light assemblies 300, each positioned generally mid-way between a side center light assembly 200 and a corner light assembly 100, as shown in FIGS. 4 and 5, an additional amount of lighting will be provided on the sides of the volleyball court, without generating glare or shadows. This third embodiment is useful for high-level competition in night-time beach volleyball.

Figure 7C:
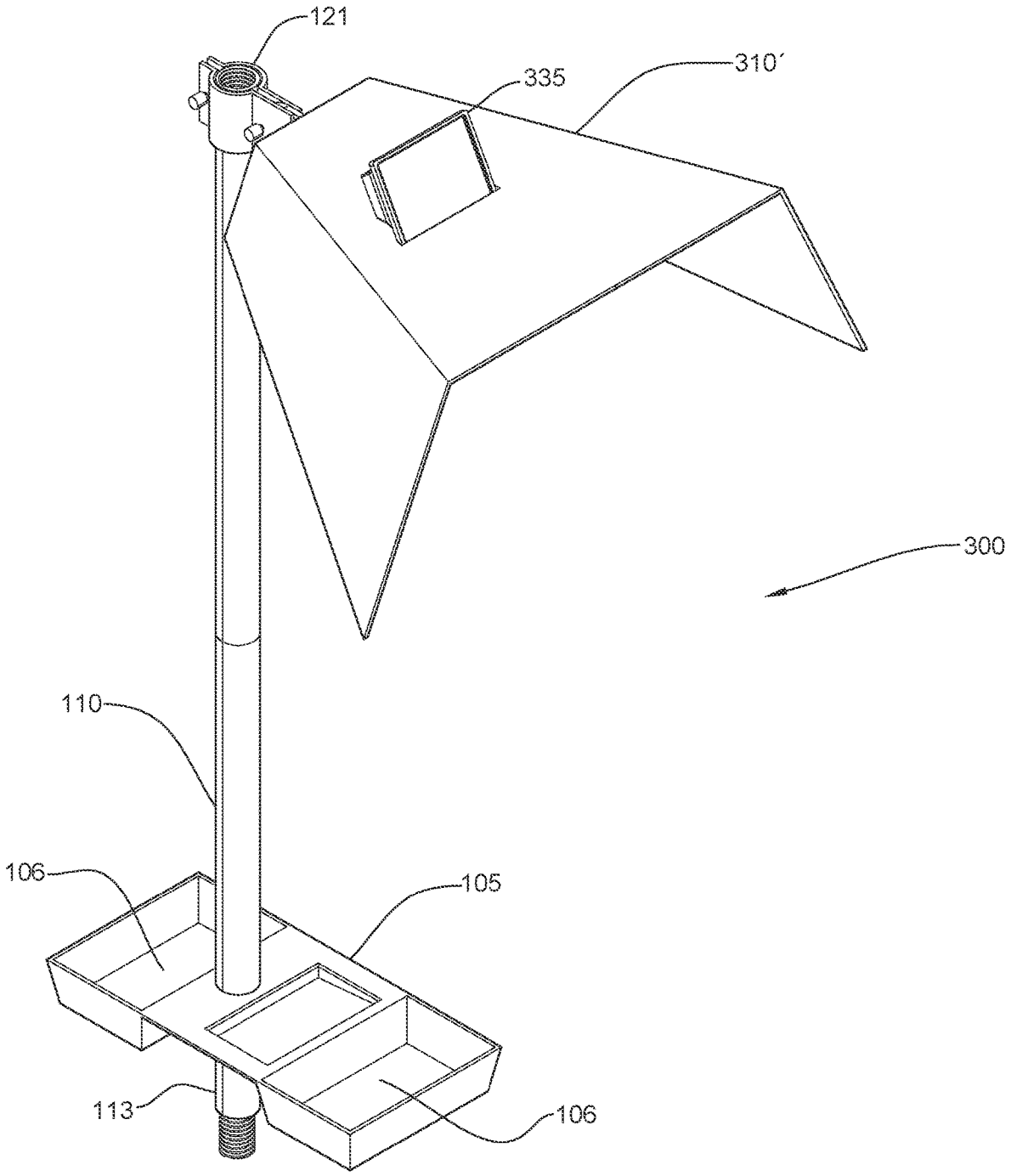
FIG. 7C is an alternative embodiment of the mid-court light assembly of FIG. 7A.

In a further embodiment shown in FIG. 7C, a light fixture 310' includes a second light fixture 335 mounted on the top surface thereof. In this embodiment, the second light fixture 335 is positioned to direct light upwards, with the light generally above the eye level of the players and thereby eliminating glare in the eyes of the players. This further embodiment additional light in the side portions of the volleyball court in the areas above the eye level of the players.

Figure 9:
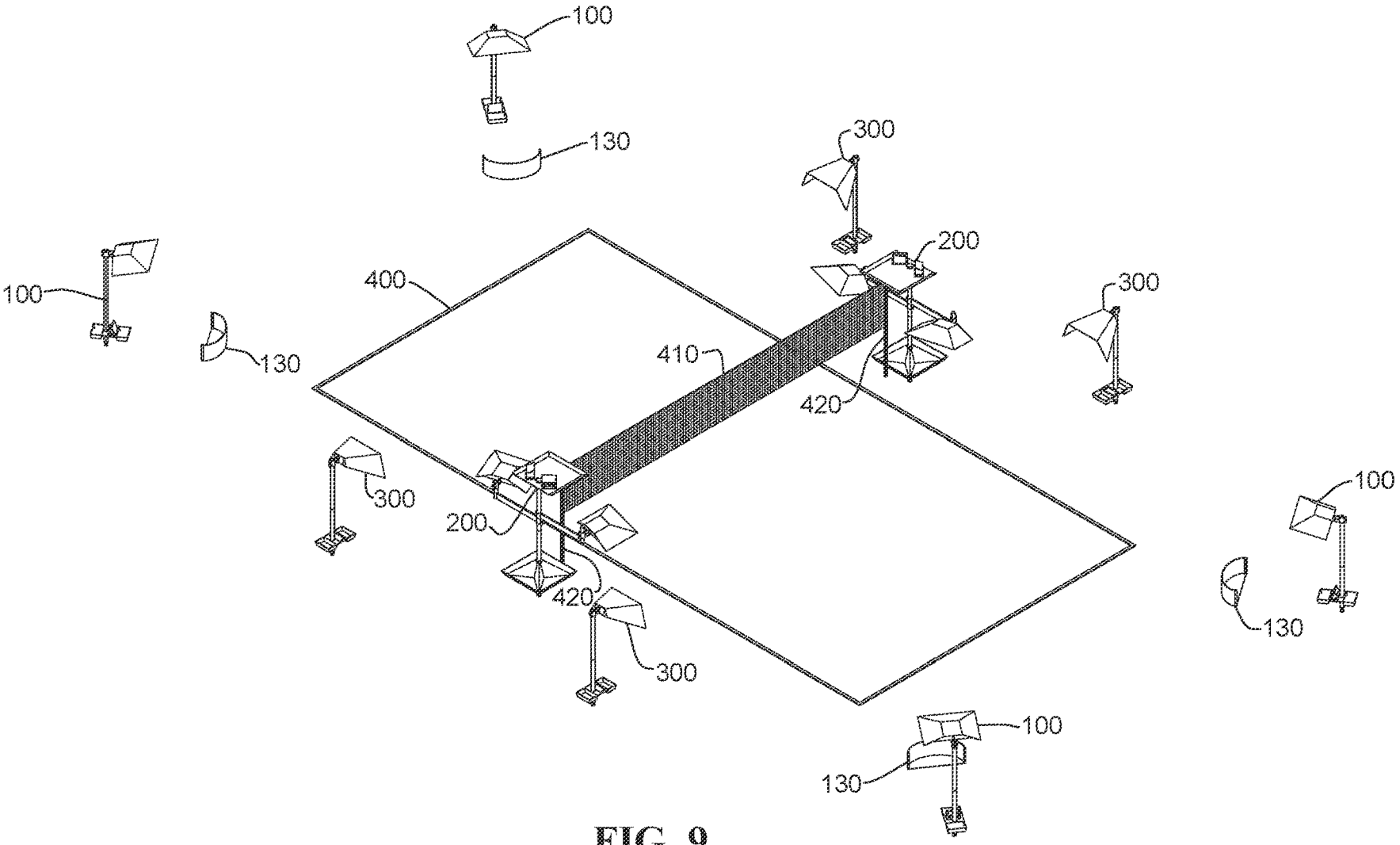
FIG. 9 is a top corner view of a volleyball court showing the position of the light assemblies according to embodiments of the present disclosure.
Figure 10:
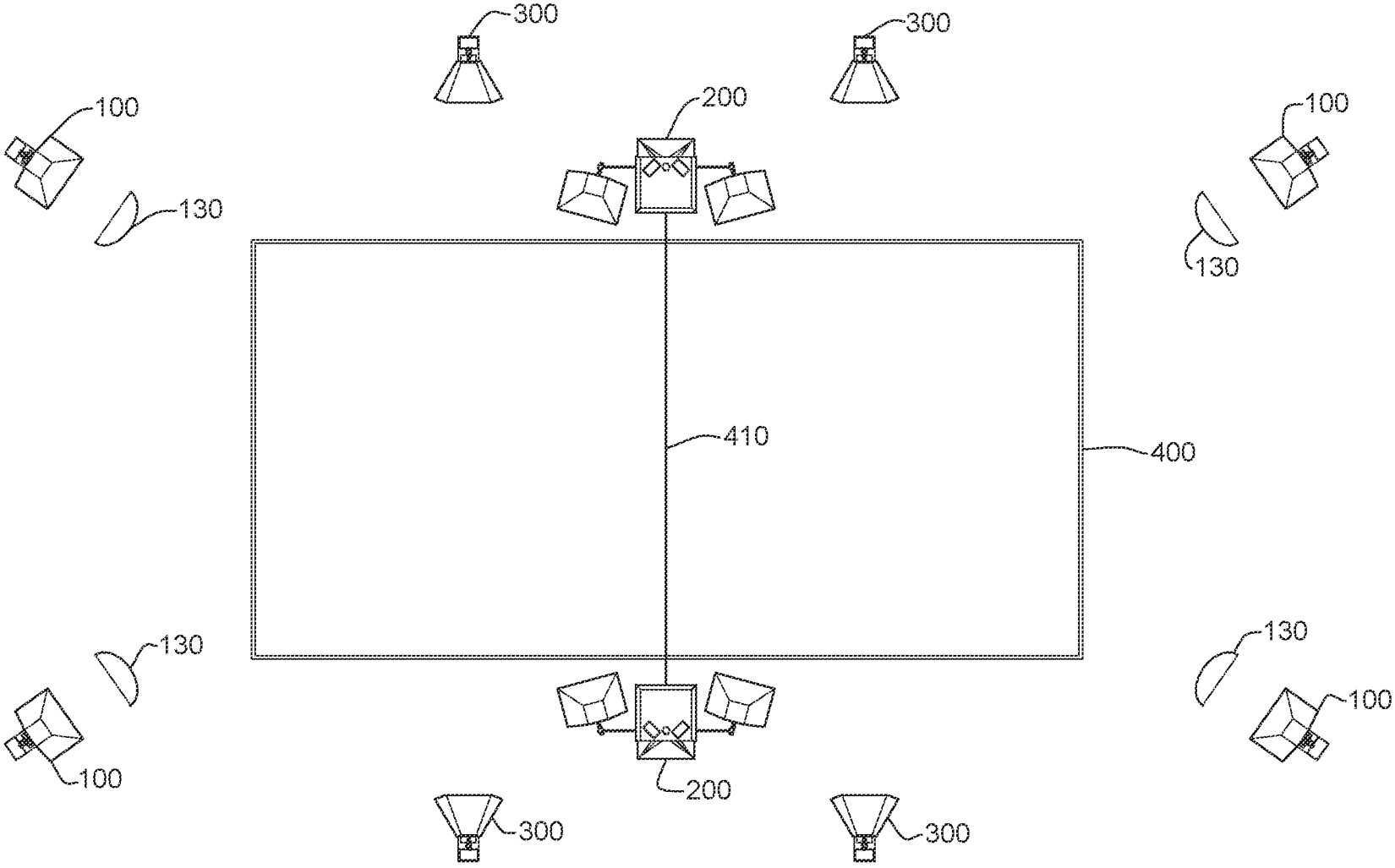
FIG. 10 is a top view of a volleyball court showing the position of the light assemblies according to embodiments of the present disclosure.

Referring now to FIGS. 9 and 10, the positioning of the various light assemblies is shown in relation to a volleyball court 400 having a net 410 at a center portion held up by two poles 420. In the first embodiment, only four of the corner light assemblies 100 are provided (along with associated glare protectors 130) at each corner of volleyball court 400. In the second embodiment, two side center light assemblies 200 are also provided, each adjacent to one of the poles 420. In the third embodiment, four mid-court light assemblies 300 are added, each positioned mid-way between a respective side center light assembly 200 and a corner light assembly 100.

A number of additional alternative embodiments of the volleyball lighting system may also be provided using the three different types of light assemblies 100, 200, and 300. First, in one alternative embodiment, a volleyball lighting system includes only two side center light assemblies 200, one on each side of a volleyball court directly adjacent to each volleyball net pole, as shown in FIGS. 4 and 5, or as part of the volleyball net pole (as discussed above). This system provides lighting generally above and below the eye level of a player in the area adjacent to the net and provides adequate lighting for casual non-competitive volleyball games.

In a second alternative embodiment, a volleyball lighting system includes two side center light assemblies 200, one on each side of a volleyball court directly adjacent to each volleyball net pole, as shown in FIGS. 4 and 5, or as part of the volleyball net pole (as discussed above), and four mid-court assemblies 300. Each mid-court assembly 300 positioned on a side of the volleyball court at a point halfway between a side center court assembly 200 and a respective one of the corners of the volleyball court. This system provides lighting generally above and below the eye level of a player in the area adjacent to the net, and additional lighting at a level generally below the eye level of the volleyball players in order to eliminate glare in the area directly adjacent to each mid-court assembly 300. This system provides improved lighting for casual non-competitive volleyball games over the first alternative embodiment.

In a third alternative embodiment, a volleyball lighting system includes four corner light assemblies 100, one positioned at each corner of a beach volleyball court, and four mid-court assemblies 300, each positioned on a side of the volleyball court at a point halfway between a side center court assembly 200 and a respective one of the corners of the volleyball court. As discussed above, the corner light assemblies 100 each emits light in two directions. In one path the light is emitted generally horizontally and below horizontal, allowing the players to see their position on the volleyball court in relation to other players, the net, and the volleyball court boundaries, without being subjected to glare from the upper light fixtures. In another path, light is emitted upwards and outward—illuminating a lower portion of the volleyball in flight, with the light generally above the eye level of the players and eliminating glare from the corner light assemblies 100. This system also provides additional lighting from each mid-court assembly 300 at a level generally below the eye level of the volleyball players in order to eliminate glare in the area directly adjacent to each mid-court assembly 300. This system provides improved lighting for casual non-competitive volleyball games over the first alternative embodiment in a different way than the second alternative embodiment.

Figure 11:
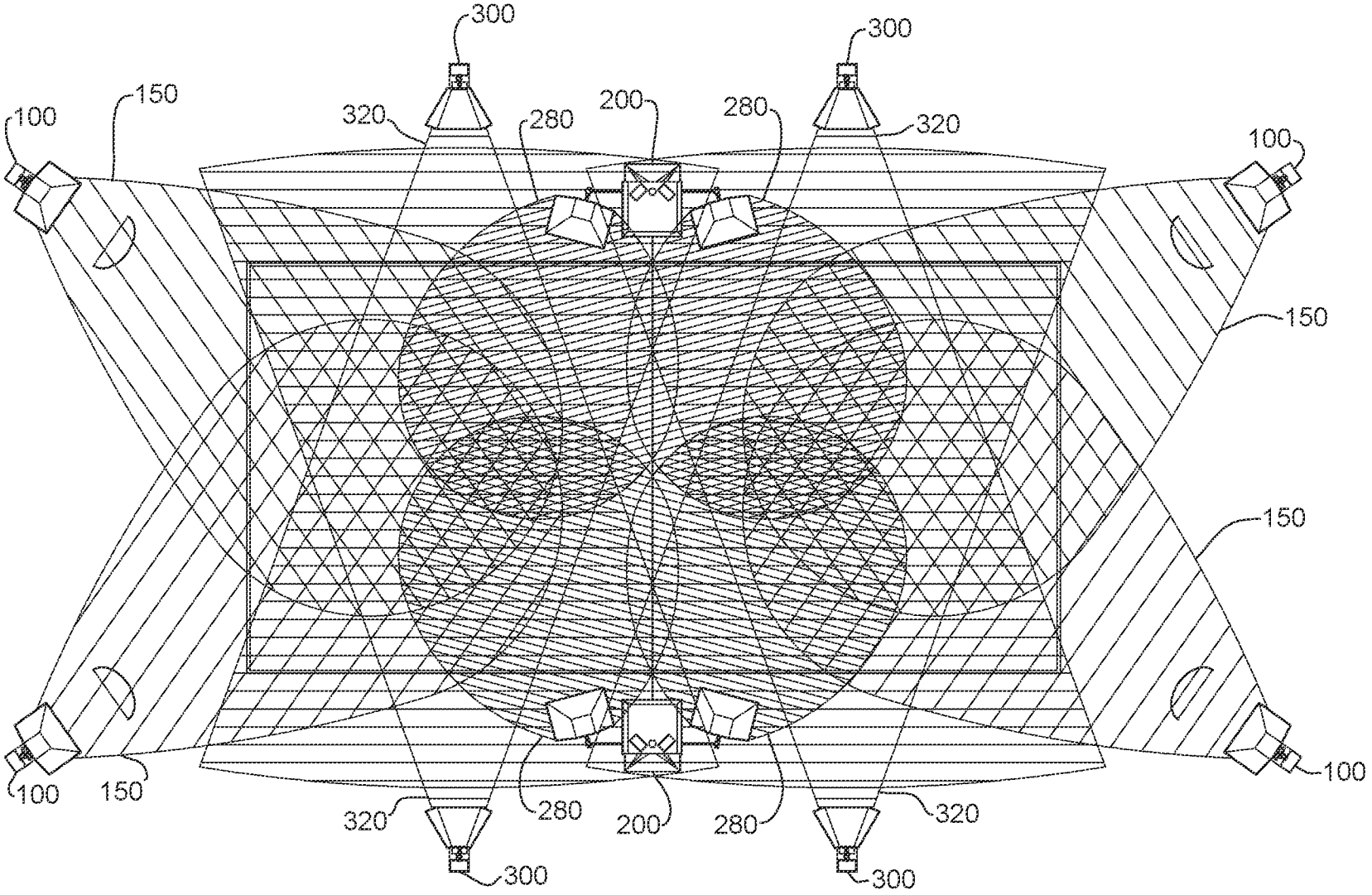
FIG. 11 is a top view of a volleyball court showing the light patterns dispersed from all the light emitting elements focused below the eye level of volleyball players on the volleyball court.
Figure 12:
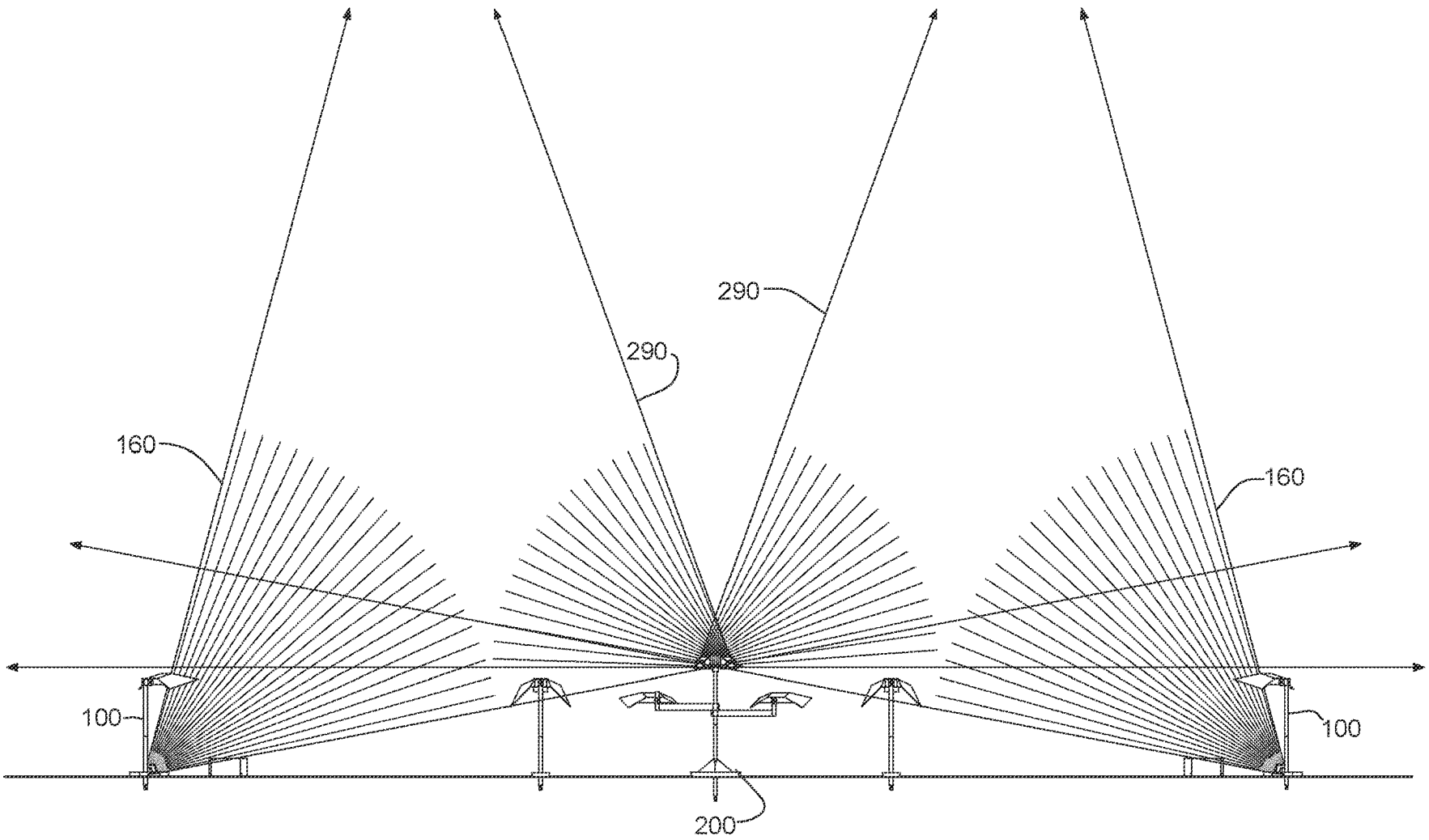
FIG. 12 is a side view of a volleyball court showing light patterns dispersed from light emitting elements in the center light assembly and the corner light assembly which are focused above the eye level of volleyball players on the volleyball court.
Figure 13:
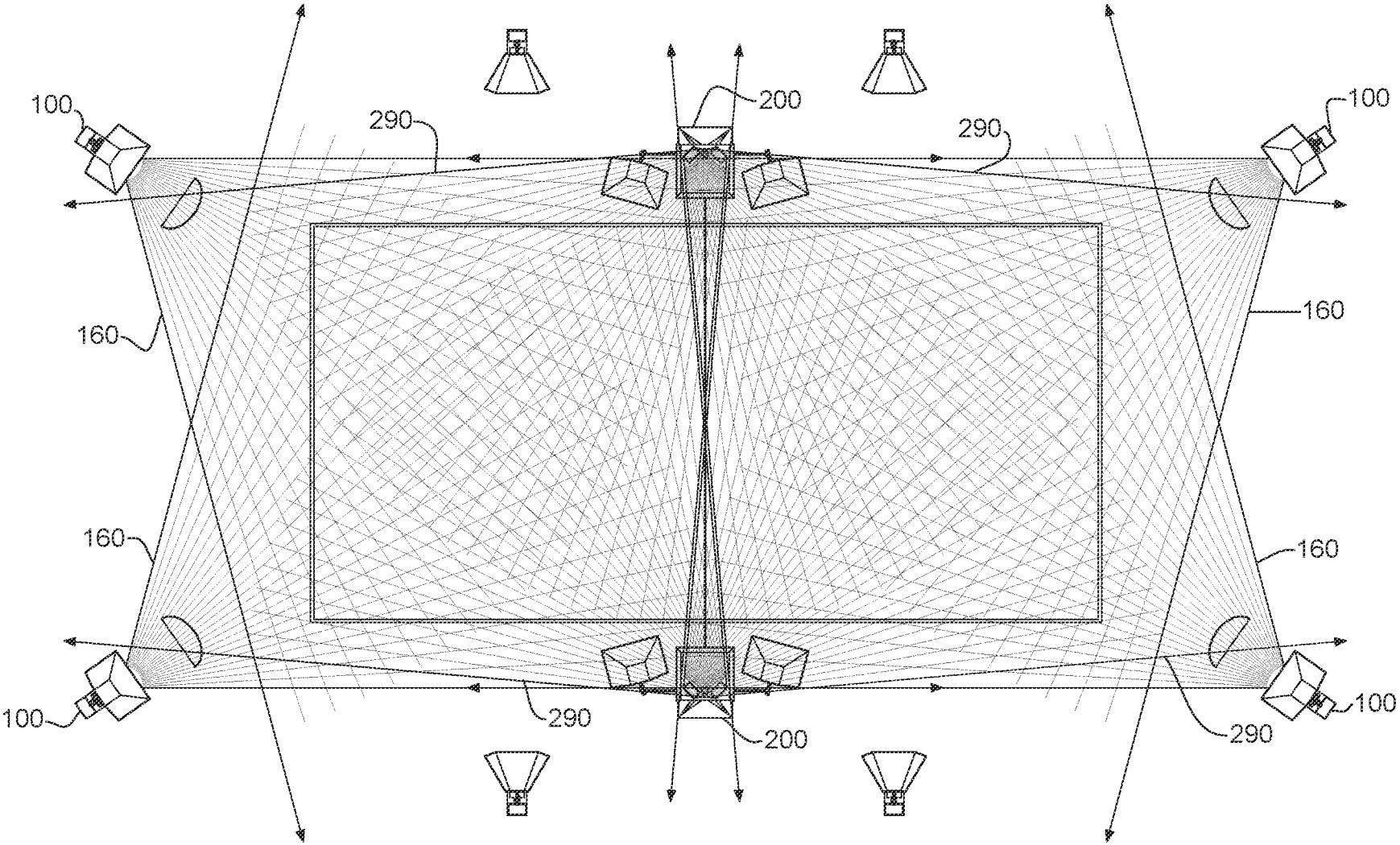
FIG. 13 is a top view of a volleyball court showing the light patterns dispersed from all the light emitting elements focused above the eye level of volleyball players on the volleyball court.

Referring now to FIG. 11, the below eye level light patterns 150, 280 and 360 from the three different types of light assemblies 100, 200, and 300, respectively, are shown overlaid upon each other in order to generate light over the entire volleyball court. Similarly, FIGS. 12 and 13 show how the above eye level light patterns 160 and 290, from the corner light assembly 100 and side center light assembly 200, respectively, are distributed in order to ensure that all areas above the eye level of a volleyball player on the volleyball court are lit up to ensure the ball is in view at all times during play.

Figure 14A:
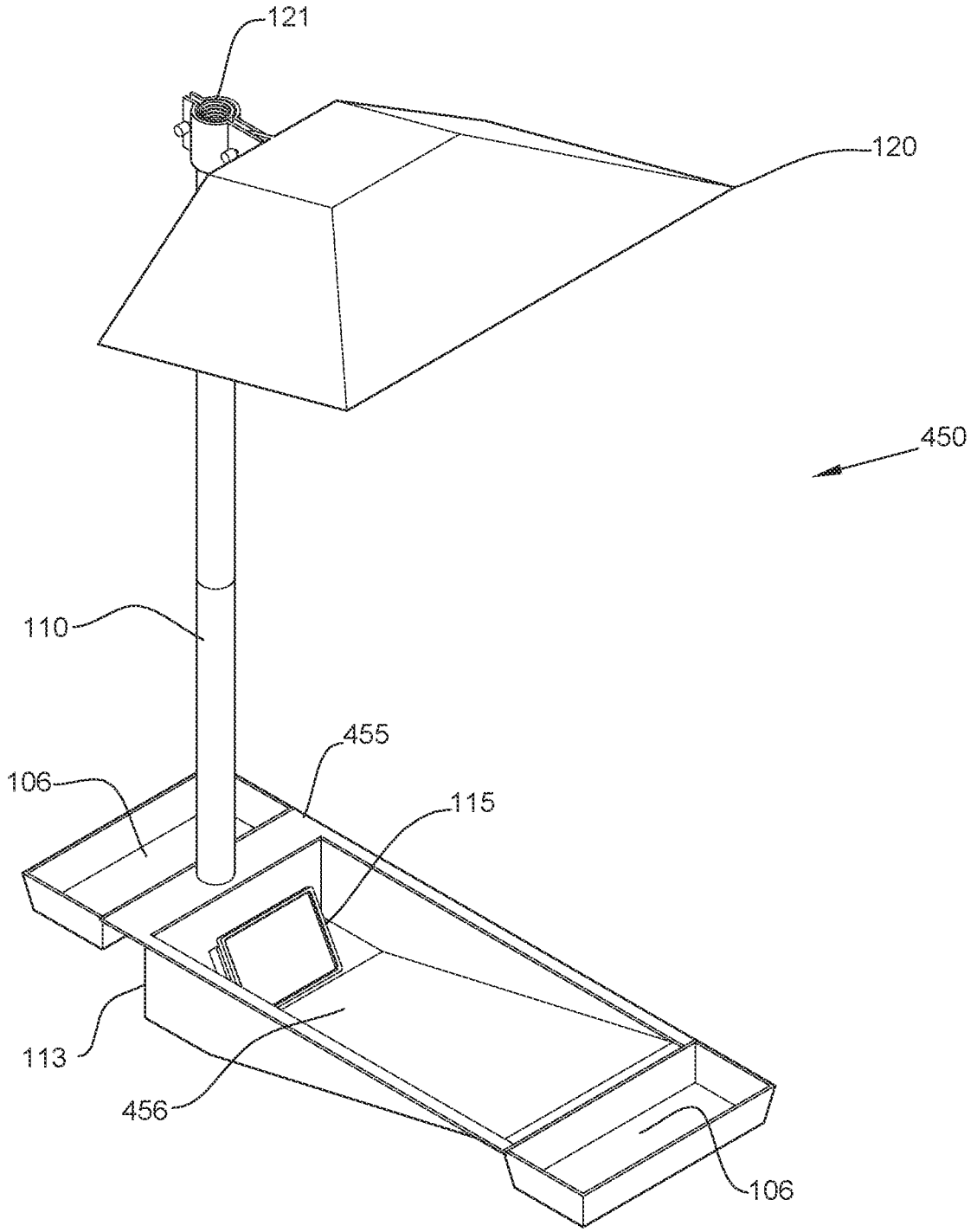
FIG. 14A is a top front side view of another alternative embodiment of a corner light assembly according to the present disclosure.

Referring now to FIG. 14A, an alternative embodiment of a corner light assembly 450 includes a base portion 455, a vertical support pole 110 fixedly mounted to base portion 455 via threads in a lower portion thereof that mate with a threaded aperture in base portion 455, a lower light emitting element 115 mounted in a cavity 416 formed in the base portion 455, and an upper light fixture 120 mounted to vertical support pole via clamp mechanism 121 (upper light fixture 120 is shown in more detail in FIG. 1B). Vertical support pole 110 may be fixedly secured to the base portion 455 in other ways, e.g., via pins passing through apertures in the vertical support pole 110 and a collar formed in an aperture in the base portion 455. As with the first embodiment, below ground member 113 is optionally coupled to a lower surface of base portion 455 (e.g., by threads that mate with threads on a bottom portion of vertical support pole 110 that pass through base portion 455) in order to better secure the base portion 455 when corner light assembly 450 is mounted in sand as is normally present at a beach. The base portion 455 preferably includes front and back cavities 106 that may be filled with sand or other material in order to better secure the corner light assembly 450 to the ground during use. Cavity 456 extends downward below the grade of the ground (surface) upon which base portion 455 is mounted and includes a flat rear portion at a fixed depth below grade and a sloped front portion extending from the flat rear portion to an at grade level at the front of cavity 416. By mounting light fixture 115 below grade, in particular within a below grade cavity with a sloped front portion, there is no need for a separate glare protector in this embodiment of the corner light assembly because the sloped front portion defining the cavity 456 acts an integral glare protector.

Figure 14B:
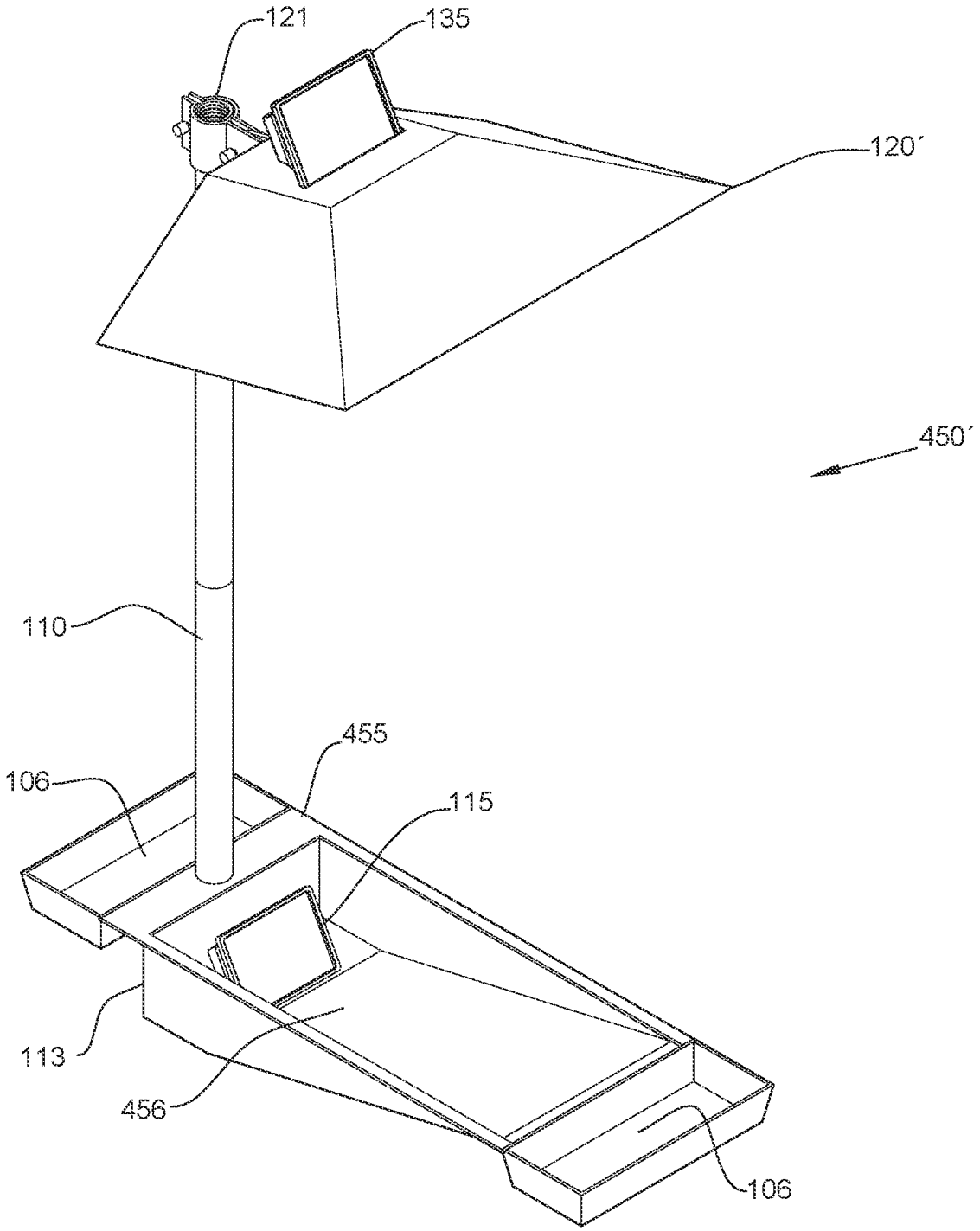
FIG. 14B is a further alternative embodiment of the mid-court light assembly of FIG. 14A.

In a further embodiment shown in FIG. 14B, the upper light fixture 120' for corner light assembly 450' includes a second light fixture 135 mounted on the top surface thereof in the same manner as in the embodiment shown in FIG. 1C. As with the FIG. 1C embodiment, in this embodiment the second light fixture 135 is positioned to direct light outward and upward with the light generally above the eye level of any of the players on the court and thereby eliminating glare in the eyes of the players. This further embodiment supplements the light from lower light fixture 115 and provides additional light in the rear portions of the volleyball court in the areas above the eye level of the players.

Figure 15:
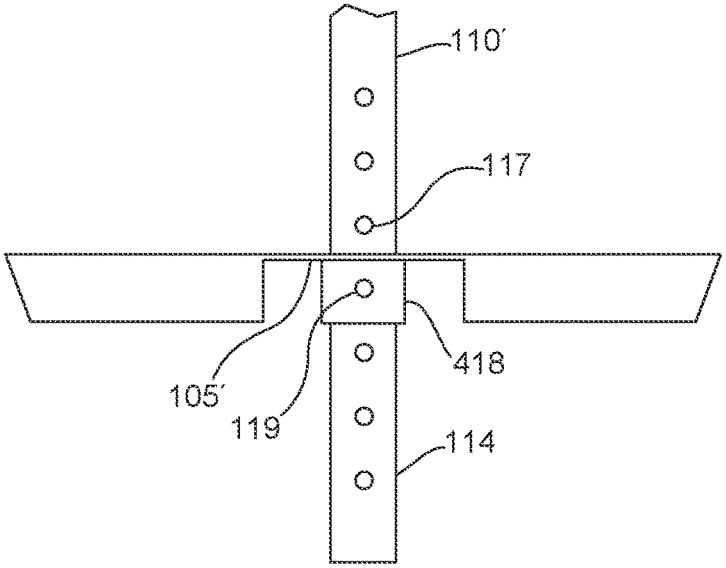
FIG. 15 is a side view of an alternative connection between the base and pole for the light fixtures of the present disclosure.

An alternative embodiment of attaching a pole 110' to base portion 105' is shown in FIG. 15. This alternative embodiment may be used with any of the light fixtures disclosed herein, including corner light assembly 100, 450, 450', side center light assembly 200, and the mid-court light assembly 300. In this alternative embodiment, a single pole 110' replaces the pole 110, 210 and associated ground member 113, 213 shown in the prior embodiments. In this embodiment, a lower portion of the pole 110' includes one or more apertures 117 passing directly through the pole 110'. One of the apertures 117 is matched to an aperture 119 in a collar 418 on the lower side of base portion 105', and the pole 110' may be secured to the base portion 105' by a pin or bolt in conventional manner. When the lower portion of the pole 110' includes a series of apertures 117, the portion 114 of pole 110' below grade can be adjusted. This allows base portion 105' to be secured in different mounting conditions, i.e., a volleyball court positioned in an area with loose sand may require a larger portion 114 of pole 110' below grade than when the court is positioned on heavily compacted dirt or sand.

As discussed above, in one alternative embodiment, the vertical support pole 210 of each side center light assembly 200 may also hold up the volleyball net, eliminating the need for a separate support pole on each side of the net. In two other alternative embodiments, the volleyball net itself can be used to support the center light assemblies.

Figure 16A:
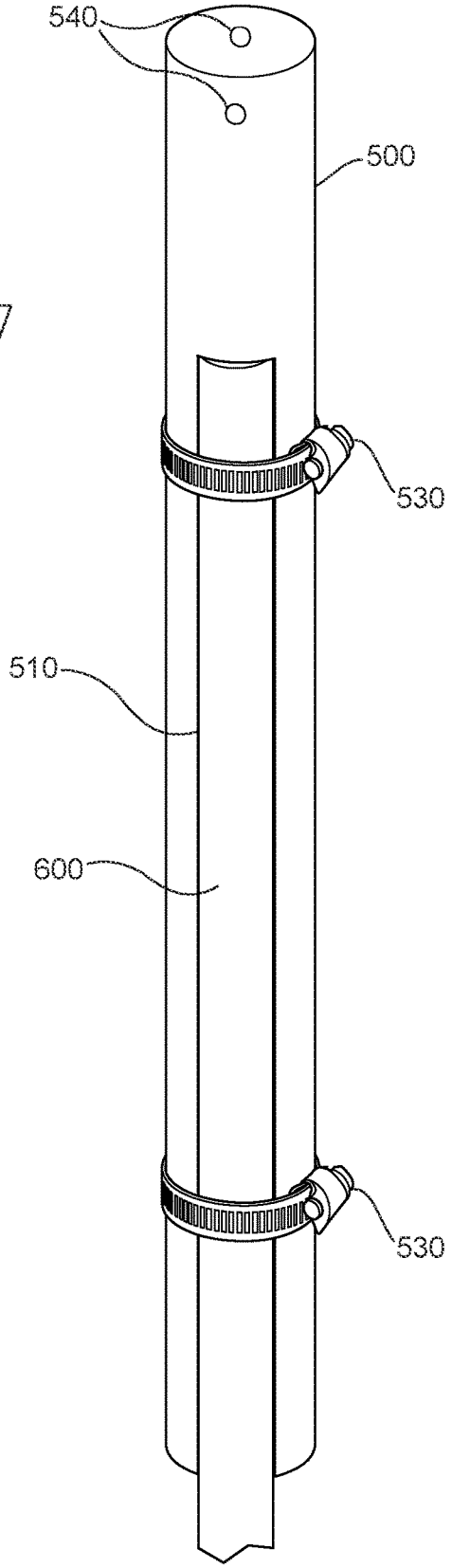
FIG. 16A is a side view of a pole extension embodiment with the pole extension attached directly over the volleyball net pole for use with the mid-court light assembly of FIG. 7C.
Figure 16B:
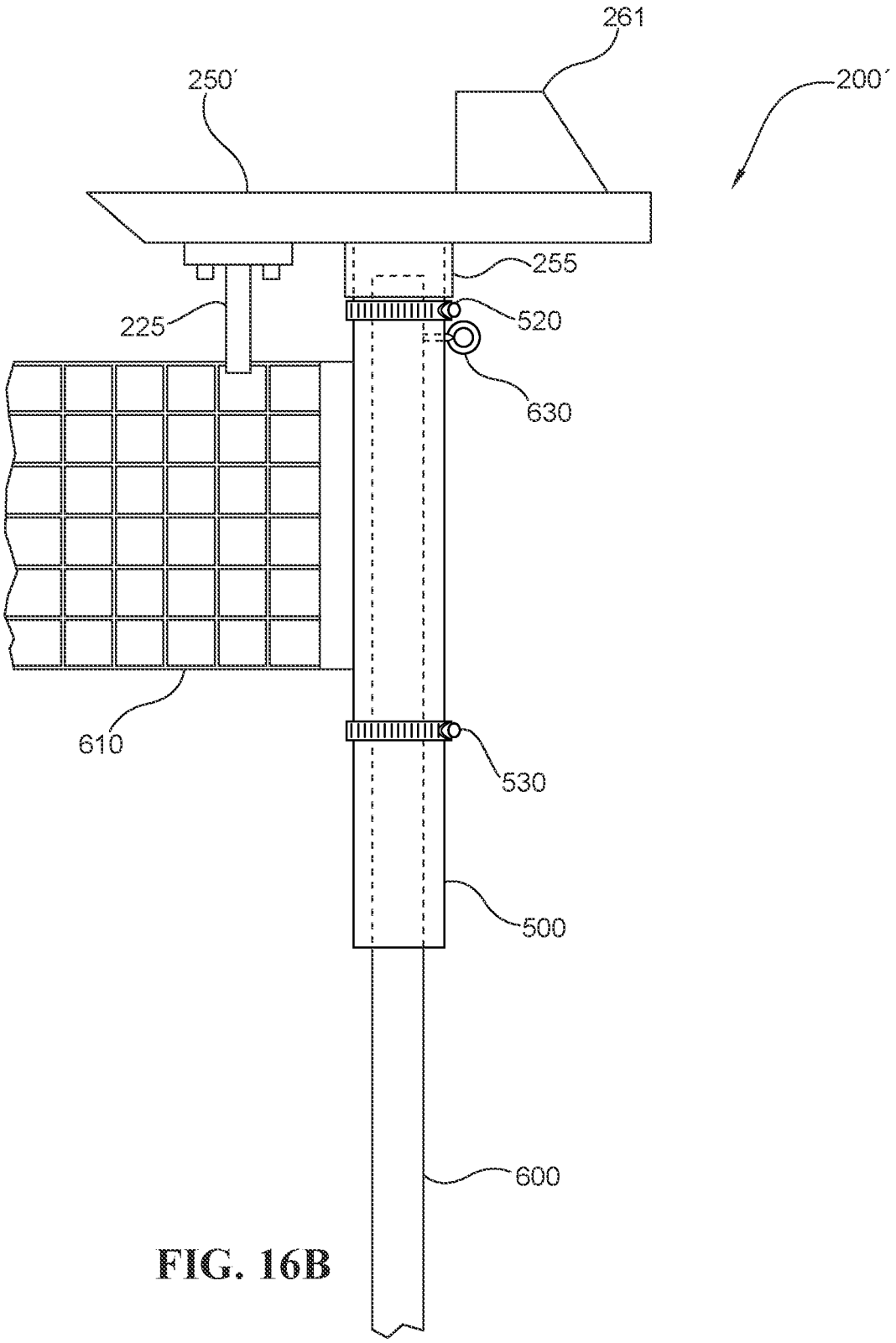
FIG. 16B is a side view of the pole extension attached to the volleyball net pole.
Figure 17A:
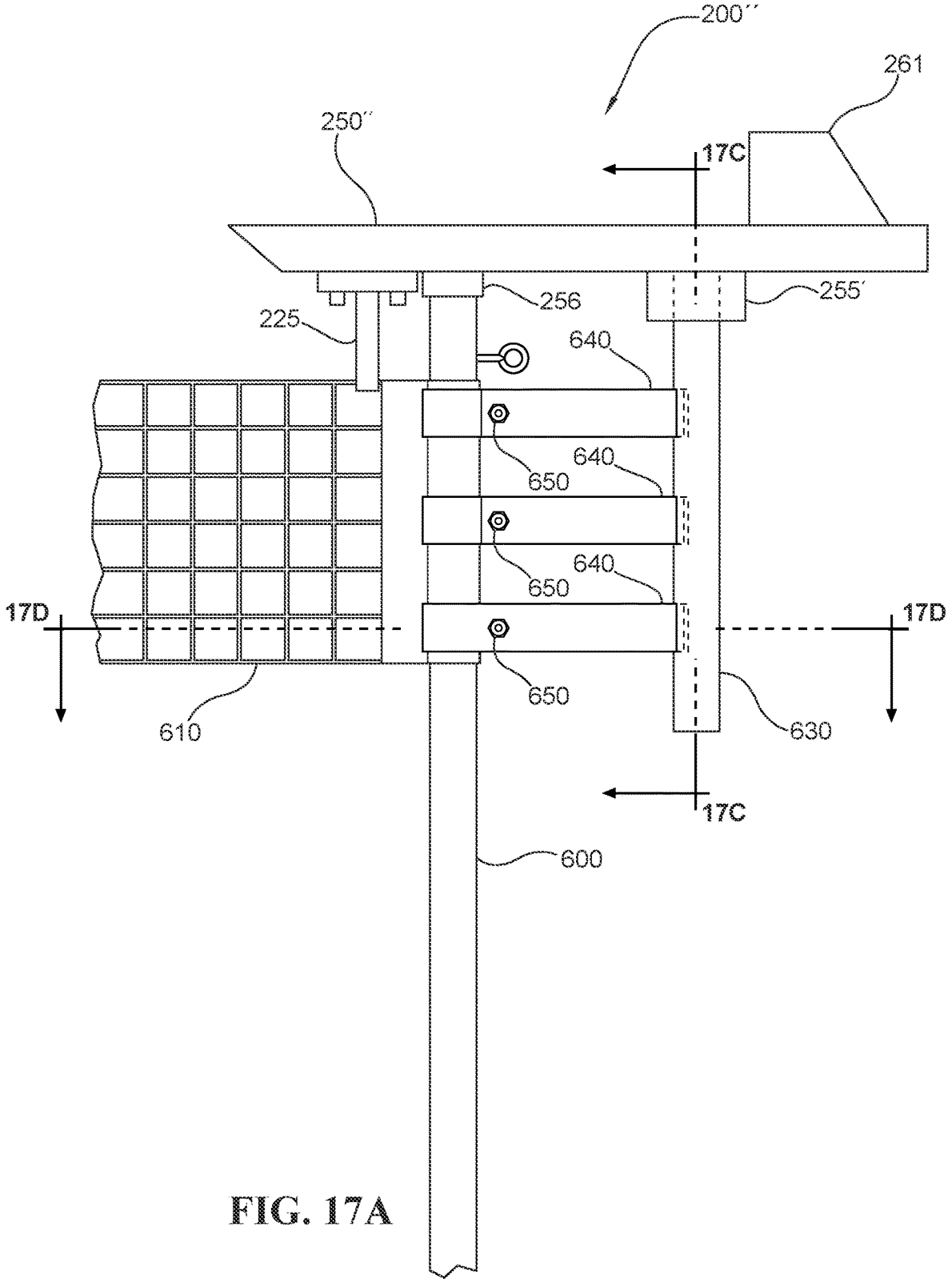
FIG. 17A is a side view of a pole extension embodiment with the pole extension attached adjacent to the volleyball net pole for use with the mid-court light assembly of FIG. 7C.
Figure 17B:
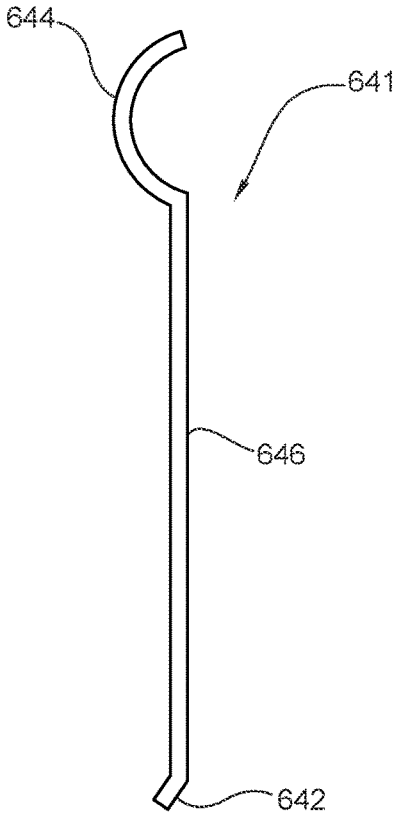
FIG. 17B is a top view of one of the pole attachment arms used to couple the pole extension to the volleyball pole.
Figure 17C:
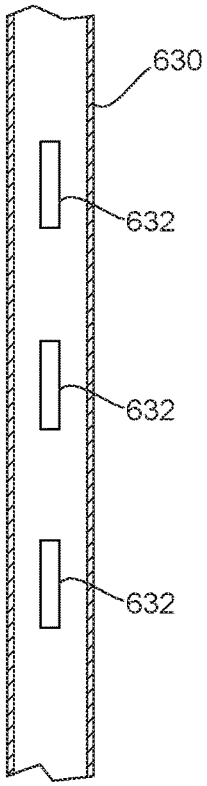
FIG. 17C is a side sectional view of the pole extension.
Figure 17D:
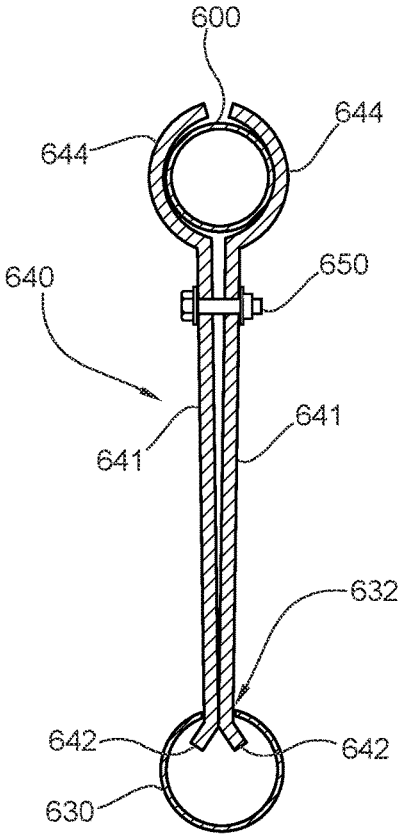
FIG. 17D is a top sectional view of the pole attachment arms used with the couple the pole extension to the volleyball net pole.

In one alternative embodiment shown in FIGS. 16A and 16B, side center light assembly 200' includes a sleeved tube 500 which fits over the volleyball pole 600. The sleeved tube 500 preferably includes slits 510 on opposing sides that allow the sleeved tube 500 to fit over of the net 610 on one side of volleyball pole 600 (i.e., where the net 610 is attached to the volleyball pole 600), and a mounting eye bolt 520 or other similar type of mounting member (for attaching guy lines used to secure the pole to the ground) on the side of volleyball pole 600 opposing the net 610. In some cases, the slit 510 may be on only one side of sleeved tube 500, and an eye bolt may be mounted directly to sleeved tube 500 on the other side thereof. The sleeved tube 500 slips over the top of the volleyball pole 600, as shown in FIG. 16A, and is held in place with one or more clamps 530. As one of ordinary skill in the art will readily recognize, there are other ways to secure the sleeved tube 500 to the volleyball pole 600. An upper platform 250' is mounted over sleeved tube 500 via, for example, a collar 255 on the lower side of upper platform 250'. Bolts or pins may be used to secure the collar 255 to sleeved tube 500 in a conventional manner. Two light fixtures 261 are mounted on top of upper platform 250' in the same manner as in the other embodiments of a midcourt light fixture. In addition, two lower light fixtures 230 (not shown) are attached to the respective arm members 225 (one on each side of net 610) in the same manner as the embodiment of FIG. 4C.

In another alternative embodiment shown in FIGS. 17A to 17D, side center light assembly 200" includes a tube 630 which is mounted adjacent to the volleyball pole 600 via a series of extension arms 640. An upper platform 250" is mounted over tube 630 via, for example, a collar 255' on the lower side of upper platform 250". Bolts or pins may be used to secure the collar 255' to tube 630 in a conventional manner. Two light fixtures 261 (not shown) are mounted on top of upper platform 250" in the same manner as in the other embodiments of a midcourt light fixture. In addition, two lower light fixtures 230 (not shown) are attached to the respective arm members 225 (one on each side of net 610) in the same manner as the embodiment of FIG. 4C. In addition, upper platform 250" preferably includes a second collar 256 which fits over the top of volleyball pole 600 in order to provide additional stability to the upper platform 250". The upper platform 250" may simply rest against the top of volleyball pole 600 or bolts or pins may be used to secure the second collar 256 to volleyball pole 600 in a conventional manner. Each of the extension arms 640 consists of two members 641. Each of the two members 641 includes a tail end 642 that is adapted to fit into a slot 632 on tube 630 and a head end that is semi-circular and adapted to fit partially around the diameter of volleyball pole 600, as shown in FIG. 7D. The two members 641 are held together (and thus secured to the volleyball pole 600) using mounting hardware 650 (e.g., bolts and nuts).

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A first light assembly for lighting a volleyball court, comprising:

a base adapted to be positioned on a surface, the base forming a cavity extending downward below a grade of the surface, a rear portion of the cavity having a fixed depth below the grade of the surface, a front portion of the cavity sloped from the fixed depth at a rear part of the front portion to the grade of the surface at a front part of the front portion;

a vertical pole fixedly coupled to the base;

an upper light fixture coupled to the vertical pole at a second end thereof, the second end opposite from a first end thereof, the upper light fixture adapted to emit light outward and downward at a level generally below an eye level of any player on the volleyball court; and a lower light element mounted in the cavity in the base, the lower light element mounted in a manner to emit light outwards and upwards.

2. The first light assembly of claim 1, wherein the upper light fixture comprises:

a hood;

a light emitting element mounted in an interior portion of the hood; and an adjustment mechanism attached to the hood to allow the hood to rotate up and down with respect to the vertical pole so that a vertical orientation of the hood with respect to the vertical pole can be selected by a user to ensure that light is emitted from the light emitting element outward and downward at a level generally below an eye level of any player on the volleyball court.

3. The first light assembly of claim 2, wherein the upper light fixture is coupled to the vertical pole via a clamp mechanism clamped to the second end of the vertical pole that is connected to the adjustment mechanism on the hood of the upper light fixture.

4. The first light assembly of claim 1, further comprising a below ground member coupled to a bottom side of the base to secure the base to a ground surface during use.

5. The first light assembly of claim 1, wherein the base includes at least one cavity on a top surface thereof for containing material used to secure the base to a ground surface during use.

6. A first light assembly for lighting a volleyball court, comprising:

a base;

a vertical pole fixedly coupled to the base;

an upper light fixture coupled to the vertical pole at a second end thereof, the second end opposite from a first end thereof, the upper light fixture adapted to emit light outward and downward at a level generally below an eye level of any player on the volleyball court and outward and upward at a level generally above an eye level of any player on the volleyball court; and a lower light element mounted in the cavity in the base, the lower light element mounted in a manner to emit light outwards and upwards.

7. The first light assembly of claim 6, wherein the upper light fixture comprises:

a hood;

a first light emitting element mounted in an interior portion of the hood, the first light emitting element emitting light outward and downward at a level generally below an eye level of any player on the volleyball court; and a second light emitting element mounted on an exterior portion of the hood, the second light emitting element emitting light outward and upward at a level generally above an eye level of any player on the volleyball court.

8. A second light assembly for lighting a volleyball court, comprising:

a vertical pole;

an upper light assembly mounted to a top end of the vertical pole, the upper light assembly adapted to emit light outwards and upwards at a level above the eye level of any player on the volleyball court; and two lower light fixtures coupled to the upper light assembly via associated arm members, the two lower light fixtures adapted to emit light outward and downward at a level generally below an eye level of any player on the volleyball court.

9. A second light assembly for lighting a volleyball court, comprising:

a sleeved tube for securely mounting over a volleyball net pole, the sleeved tube having a first slit on one side for accepting an edge of a volleyball net;

an upper light assembly mounted to a top end of the sleeved tube, the upper light assembly adapted to emit light outwards and upwards at a level above the eye level of any player on the volleyball court; and two lower light fixtures coupled to the upper light assembly via associated arm members, the two lower light fixtures adapted to emit light outward and downward at a level generally below an eye level of any player on the volleyball court.

10. The second light assembly of claim 9, wherein the sleeved tube has a second slit on a side opposite the first side for accepting a mounting member on the volleyball net pole.

11. The second light assembly of claim 9, further comprising a clamp for securely mounting the sleeved tube to the volleyball net pole.

12. A second light assembly for lighting a volleyball court, comprising:

a tube, the tube having a plurality of slots on one side thereof;

a plurality of extension arms for coupling the tube to a volleyball net pole, each of the plurality of extension arms having a first end mounted in an associated one of the plurality of slots in the tube and a second end securely mounted to the volleyball net pole;

an upper light assembly mounted to a top end of the tube, the upper light assembly adapted to emit light outwards and upwards at a level above the eye level of any player on the volleyball court; and two lower light fixtures coupled to the upper light assembly via associated arm members, the two lower light fixtures adapted to emit light outward and downward at a level generally below an eye level of any player on the volleyball court.

13. The second light assembly of claim 12, wherein each of the plurality of extension arms comprises two members, each of the two members having a tail end adapted to fit within the associated one of the plurality of slots in the tube and a head end that is semi-circular and adapted to fit partially around the diameter of the volleyball net pole.

14. The second light assembly of claim 13, wherein the two members for each of the plurality of extension arms are securely mounted to the volleyball net pole by being held together with mounting hardware.

15. A third light assembly for lighting a volleyball court, comprising:

a base;

a vertical pole fixedly coupled to the base; and a light fixture coupled to the vertical pole at a second end thereof, the second end opposite from a first end thereof, the light fixture adapted to emit light outward and downward at a level generally below an eye level of any player on the volleyball court and to emit light outward and upward at a level generally above an eye level of any player on the volleyball court.

16. The third light assembly of claim 15, wherein the light fixture comprises:

a hood;

a first light emitting element mounted in an inner portion of the hood; and a second light emitting element mounted on an outer portion of the hood.

17. A system for lighting a volleyball court comprising:

a plurality of first light assemblies for mounting around a perimeter of the volleyball court, each first light assembly comprising:

a base;

a vertical pole fixedly coupled to the base;

an upper light fixture coupled to the vertical pole at a second end thereof, the second end opposite from a first end thereof, the upper light fixture adapted to emit light outward and downward at a level generally below an eye level of any player on the volleyball court; and a lower light element mounted in a slot on the base, the lower light element mounted in a manner to emit light outwards and upwards; and a plurality of third light assemblies for mounting around the perimeter of the volleyball court, each third light assembly comprising:

a base;

a vertical pole fixedly coupled to the base; and a light fixture coupled to the vertical pole at a second end thereof, the second end opposite from a first end thereof, the light fixture adapted to emit light outward and downward at a level generally below an eye level of any player on the volleyball court.

18. The system of claim 17, wherein the upper light fixture of each of the plurality of first light assemblies comprises:

a hood;

a light emitting element mounted in an interior portion of the hood; and an adjustment mechanism attached to the hood to allow the hood to rotate up and down with respect to the vertical pole so that a vertical orientation of the hood with respect to the vertical pole can be selected by a user to ensure that light is emitted from the light emitting element outward and downward at a level generally below an eye level of any player on the volleyball court.

19. The system of claim 18, wherein the upper light fixture of each of the plurality of first light assemblies is coupled to the vertical pole via a clamp mechanism clamped to the second end of the vertical pole that is connected to the adjustment mechanism on the hood of the light fixture.

20. The system of claim 17, wherein each first light assembly further comprises a below ground member coupled to a bottom side of the base to secure the base to a ground surface during use.

21. The system of claim 17, wherein the base of each first light assembly of the plurality of first light assemblies includes at least one cavity on a top surface thereof for containing material used to secure the base to a ground surface during use.

22. The system of claim 17, wherein the base includes an integral glare protector for controlling a dispersal of light emitted by the lower light element positioned to ensure that no light is emitted at the eye level of any player on the volleyball court.

23. The system of claim 17, each first light assembly further comprising a below ground member coupled to a bottom side of the base to secure the base to a ground surface during use.

24. The system of claim 17, further comprising a glare protector associated with each first light assembly for controlling a dispersal of light emitted by the lower light element positioned to ensure that no light is emitted at the eye level of any player on the volleyball court.

25. The system of claim 24, wherein the glare protector is vertically adjustable.

26. The system of claim 17, wherein the light fixture of each of the plurality of third light assemblies comprises:

a hood;

a light emitting element mounted in a bracket assembly that couples to the hood; and an adjustment mechanism attached to the bracket assembly to allow the hood to rotate up and down with respect to the vertical pole so that a vertical orientation of the hood with respect to the vertical pole can be selected by a user to ensure that light is emitted from the light emitting element outward and downward at a level generally below an eye level of any player on the volleyball court.

27. The system of claim 26, wherein the light fixture of each of the plurality of third light assemblies is coupled to the vertical pole via a clamp mechanism clamped to the second end of the vertical pole that is connected to the adjustment mechanism on the hood of the light fixture.

28. The system of claim 17, each third light assembly further comprising a below ground member coupled to a bottom side of the base to secure the base to a ground surface during use.

29. The system of claim 17 wherein the base of each third light assembly includes at least one cavity on a top surface thereof for containing material used to secure the base to a ground surface during use.

30. A system for lighting a volleyball court comprising:

a plurality of second light assemblies for mounting around a perimeter of the volleyball court, each second light assembly comprising:

a vertical pole;

two lower light fixtures coupled to the vertical pole at a generally mid-point thereof via associated bracket arm assemblies, the two lower light fixtures adapted to emit light outward and downward at a level generally below an eye level of any player on the volleyball court; and an upper light assembly mounted to a top end of the vertical pole, the upper light assembly adapted to emit light outwards and upwards at a level above the eye level of any player on the volleyball court.

31. The system of claim 30, wherein each lower light fixture in each of the plurality of second light assemblies comprises:

a hood;

a light emitting element mounted in an interior portion of the hood; and an adjustment mechanism attached to the hood to allow the hood to rotate up and down with respect to the vertical pole so that a vertical orientation of the hood with respect to the vertical pole can be selected by a user to ensure that light is emitted from the light emitting element outward and downward at a level below an eye level of any player on the volleyball court.

32. The system of claim 31, wherein each lower light fixture in each of the plurality of second light assemblies is coupled to the vertical pole via a clamp mechanism clamped to a projecting member on the associated bracket arm assembly that is connected to the adjustment mechanism on the hood of the light fixture.

33. The system of claim 30, wherein the upper light assembly in each of the plurality of second light assemblies comprises:

an upper platform coupled to the top end of the vertical pole at a vertical height above the eye level of any player on the volleyball court; and two upper light modules each mounted in an associated slot in the upper platform, the slot positioned so that light from each upper light module is emitted upward and outwards across a portion of the upper platform, the upper platform thereby preventing any light from being dispersed below the vertical height of the upper platform.

34. The system of claim 33, wherein each upper light module in the upper light assembly in each second light assembly comprises:

a bracket; and a light emitting element mounted in an interior portion of the bracket.

35. The system of claim 30, further comprising:

a plurality of third light assemblies for mounting around a perimeter of the volleyball court, each third light assembly comprising:

a base;

a vertical pole fixedly coupled to the base; and a light fixture coupled to the vertical pole at a second end thereof, the second end opposite from a first end thereof, the light fixture adapted to emit light outward and downward at a level generally below an eye level of any player on the volleyball court.

36. The system of claim 35, wherein the light fixture of each of the plurality of third light assemblies comprises:

a hood;

a light emitting element mounted in a bracket assembly that couples to the hood; and an adjustment mechanism attached to the bracket assembly to allow the hood to rotate up and down with respect to the vertical pole so that a vertical orientation of the hood with respect to the vertical pole can be selected by a user to ensure that light is emitted from the light emitting element outward and downward at a level generally below an eye level of any player on the volleyball court.

37. The system of claim 36, wherein the light fixture of each of the plurality of third light assemblies is coupled to the vertical pole via a clamp mechanism clamped to the second end of the vertical pole that is connected to the adjustment mechanism on the hood of the light fixture.

38. The system of claim 37, each third light assembly further comprising a below ground member coupled to a bottom side of the base to secure the base to a ground surface during use.

39. The system of claim 37, wherein the base of each third light assembly includes at least one cavity on a top surface thereof for containing material used to secure the base to a ground surface during use.

40. A system for lighting a volleyball court comprising:

a plurality of first light assemblies for mounting around a perimeter of the volleyball court, each first light assembly comprising:

a base adapted to be positioned on a surface, the base forming a cavity extending downward below a grade of the surface, a rear portion of the cavity having a fixed depth below the grade of the surface, a front portion of the cavity sloped from the fixed depth at a rear part of the front portion to the grade of the surface at a front part of the front portion;

a vertical pole fixedly coupled to the base;

an upper light fixture coupled to the vertical pole at a second end thereof, the second end opposite from a first end thereof, the upper light fixture adapted to emit light outward and downward at a level generally below an eye level of any player on the volleyball court; and a lower light element mounted in the cavity in the base, the lower light element mounted in a manner to emit light outwards and upwards.

41. The system of claim 40, wherein the upper light fixture of each of the plurality of first light assemblies comprises:

a hood;

a light emitting element mounted in an interior portion of the hood; and an adjustment mechanism attached to the hood to allow the hood to rotate up and down with respect to the vertical pole so that a vertical orientation of the hood with respect to the vertical pole can be selected by a user to ensure that light is emitted from the light emitting element outward and downward at a level generally below an eye level of any player on the volleyball court.

42. The system of claim 41, wherein the upper light fixture of each of the plurality of first light assemblies is coupled to the vertical pole via a clamp mechanism clamped to the second end of the vertical pole that is connected to the adjustment mechanism on the hood of the upper light fixture.

43. The system of claim 40, wherein each first light assembly further comprises a below ground member coupled to a bottom side of the base to secure the base to a ground surface during use.

44. The system of claim 40, wherein the base of each first light assembly includes at least one cavity on a top surface thereof for containing material used to secure the base to a ground surface during use.

45. The system of claim 40, wherein the base includes an integral glare protector for controlling a dispersal of light emitted by the lower light element positioned to ensure that no light is emitted at the eye level of any player on the volleyball court.

46. The system of claim 40, further comprising a glare protector associated with each first light assembly for controlling a dispersal of light emitted by the lower light element positioned to ensure that no light is emitted at the eye level of any player on the volleyball court.

47. The system of claim 46, wherein the glare protector is vertically adjustable.

48. The system of claim 40, further comprising:

a plurality of second light assemblies for mounting around a perimeter of the volleyball court, each second light assembly comprising:

a vertical pole;

two lower light fixtures coupled to the vertical pole at a generally mid-point thereof via associated bracket arm assemblies, the two lower light fixtures adapted to emit light outward and downward at a level generally below an eye level of any player on the volleyball court; and an upper light assembly mounted to a top end of the vertical pole, the upper light assembly adapted to emit light outwards and upwards at a level above the eye level of any player on the volleyball court.

49. The system of claim 48, wherein each lower light fixture of the plurality of second light assemblies comprises:

a hood;

a light emitting element mounted in an interior portion of the hood; and an adjustment mechanism attached to the hood to allow the hood to rotate up and down with respect to the vertical pole so that a vertical orientation of the hood with respect to the vertical pole can be selected by a user to ensure that light is emitted from the light emitting element outward and downward at a level below an eye level of any player on the volleyball court.

50. The system of claim 49, wherein each lower light fixture of each of the plurality of second light assemblies is coupled to the vertical pole via a clamp mechanism clamped to a projecting member on the associated bracket arm assembly that is connected to the adjustment mechanism on the hood of the light fixture.

51. The system of claim 48, wherein the upper light fixture of each of the plurality of second light assemblies comprises:

an upper platform coupled to the top end of the vertical pole at a vertical height above the eye level of any player on the volleyball court; and two upper light modules each mounted in an associated slot in the upper platform, the slot positioned so that light from each upper light module is emitted upward and outwards across a portion of the upper platform, the upper platform thereby preventing any light from being dispersed below the vertical height of the upper platform.

52. The system of claim 51, wherein each upper light module in each of the upper light fixtures in each of the plurality of second light assemblies comprises:

a bracket; and a light emitting element mounted in an interior portion of the bracket.

53. The system of claim 48, further comprising:

a plurality of third light assemblies for mounting around a perimeter of the volleyball court, each third light assembly comprising:

a base;

a vertical pole fixedly coupled to the base; and a light fixture coupled to the vertical pole at a second end thereof, the second end opposite from a first end thereof, the light fixture adapted to emit light outward and downward at a level generally below an eye level of any player on the volleyball court.

54. The system of claim 53, wherein the light fixture of each of the plurality of third light assemblies comprises:

a hood;

a light emitting element mounted in a bracket assembly that couples to the hood; and an adjustment mechanism attached to the bracket assembly to allow the hood to rotate up and down with respect to the vertical pole so that a vertical orientation of the hood with respect to the vertical pole can be selected by a user to ensure that light is emitted from the light emitting element outward and downward at a level generally below an eye level of any player on the volleyball court.

55. The system of claim 54, wherein the light fixture of each of the plurality of third light assemblies is coupled to the vertical pole via a clamp mechanism clamped to the second end of the vertical pole that is connected to the adjustment mechanism on the hood of the light fixture.

56. The system of claim 53, each third light assembly of the plurality of third light assemblies further comprising a below ground member coupled to a bottom side of the base to secure the base to a ground surface during use.

57. The system of claim 53, wherein the base of each third light assembly of the plurality of third light assemblies includes at least one cavity on a top surface thereof for containing material used to secure the base to a ground surface during use.

58. The system of claim 40, further comprising:

a plurality of third light assemblies for mounting around a perimeter of the volleyball court, each third light assembly comprising:

a base;

a vertical pole fixedly coupled to the base; and a light fixture coupled to the vertical pole at a second end thereof, the second end opposite from a first end thereof, the light fixture adapted to emit light outward and downward at a level generally below an eye level of any player on the volleyball court.

59. The system of claim 58, wherein the light fixture of each of the plurality of third light assemblies comprises:

a hood;

a light emitting element mounted in a bracket assembly that couples to the hood; and an adjustment mechanism attached to the bracket assembly to allow the hood to rotate up and down with respect to the vertical pole so that a vertical orientation of the hood with respect to the vertical pole can be selected by a user to ensure that light is emitted from the light emitting element outward and downward at a level generally below an eye level of any player on the volleyball court.

60. The system of claim 59, wherein the light fixture of each of the plurality of third light assemblies is coupled to the vertical pole via a clamp mechanism clamped to the second end of the vertical pole that is connected to the adjustment mechanism on the hood of the light fixture.

61. The system of claim 58, each third light assembly of the plurality of third light assemblies further comprising a below ground member coupled to a bottom side of the base to secure the base to a ground surface during use.

62. The system of claim 58, wherein the base of each third light assembly of the plurality of third light assemblies includes at least one cavity on a top surface thereof for containing material used to secure the base to a ground surface during use.

* * * * *